US008919917B2

(12) United States Patent
Koike et al.

(10) Patent No.: US 8,919,917 B2
(45) Date of Patent: Dec. 30, 2014

(54) LIQUID EJECTING APPARATUS AND METHOD OF CLEANING LIQUID EJECTING HEAD OF LIQUID EJECTING APPARATUS

(75) Inventors: Kaoru Koike, Nagano-ken (JP); Toshio Kumagai, Nagano-ken (JP); Tadayuki Yoshimoto, Saitama-ken (JP)

(73) Assignee: Seiko Epson Corporation, Tokyo (JP)

( * ) Notice: Subject to any disclaimer, the term of this patent is extended or adjusted under 35 U.S.C. 154(b) by 593 days.

(21) Appl. No.: 12/862,256

(22) Filed: Aug. 24, 2010

(65) Prior Publication Data

US 2011/0050794 A1 Mar. 3, 2011

(30) Foreign Application Priority Data

Aug. 31, 2009 (JP) ..... 2009-200906

(51) Int. Cl.

| | |
|---|---|
| ***B41J 2/165*** | (2006.01) |
| ***B41J 29/38*** | (2006.01) |
| ***B41J 2/125*** | (2006.01) |
| ***B41J 2/175*** | (2006.01) |

(52) U.S. Cl.

CPC *B41J 29/38* (2013.01); *B41J 2/125* (2013.01); *B41J 2/16526* (2013.01); *B41J 2/175* (2013.01); *B41J 2/17509* (2013.01); *B41J 2/17566* (2013.01); *B41J 2/17596* (2013.01)

USPC ..... 347/22; 347/85

(58) Field of Classification Search

USPC ..... 347/6, 22, 85, 89

See application file for complete search history.

(56) References Cited

U.S. PATENT DOCUMENTS

| | | | | |
|---|---|---|---|---|
| 7,651,193 | B2 * | 1/2010 | Kawamoto et al. | 347/22 |
| 8,132,902 | B2 * | 3/2012 | Shibata et al. | 347/89 |
| 2005/0052513 | A1 | 3/2005 | Inoue | |
| 2008/0158321 | A1 * | 7/2008 | Nitta et al. | 347/89 |
| 2010/0245495 | A1 * | 9/2010 | Katada et al. | 347/85 |

FOREIGN PATENT DOCUMENTS

| | | |
|---|---|---|
| JP | 11-342634 | 12/1999 |
| JP | 2005-053047 A | 3/2005 |
| JP | 2005-081775 A | 3/2005 |
| JP | 2006-021197 A | 1/2006 |

* cited by examiner

*Primary Examiner* — Daniel Petkovsek

(57) ABSTRACT

A liquid ejecting apparatus provided with N (N≥2) liquid ejecting heads which eject liquid, the liquid ejecting apparatus including a supply path through which liquid is supplied from a tank to the N liquid ejecting heads, a circulation path through which liquid is returned from the liquid ejecting heads to the tank, N opening and closing valves that are installed for each liquid ejecting head on at least one of the supply path and the circulation path, and a liquid sending unit that applies a force sending the liquid from the tank toward the liquid ejecting heads. M opening and closing valves corresponding to M (M<N) liquid ejecting heads selected as cleaning targets are selected to be opened among the N opening and closing valves and the liquid sending unit is driven, to selectively send liquid to the M liquid ejecting heads of the cleaning targets among the N liquid ejecting heads, thereby performing cleaning.

6 Claims, 10 Drawing Sheets

LIQUID EJECTING APPARATUS AND METHOD OF CLEANING LIQUID EJECTING HEAD OF LIQUID EJECTING APPARATUS

CROSS-REFERENCE TO RELATED APPLICATION

Japanese Patent Application No. 2009-200906 is hereby incorporated by reference in its entirety.

BACKGROUND

1. Field of Invention

The present invention relates to a liquid ejecting apparatus in which a liquid ejecting head ejecting a liquid such as ink performs cleaning and a method of cleaning the liquid ejecting head of the liquid ejecting apparatus.

2. Description of Related Art

As such a liquid ejecting apparatus, for example, an ink jet printer (hereinafter, referred to as "printer") is described in JP-A-11-342634. The printer described in JP-A-11-342634 is provided with a plurality of head units (printing head) as a liquid ejecting head that ejects ink as a liquid onto a target such as a printing sheet, and ink tanks and sub-tanks that accommodate ink supplied into the head units. At the time of a purge operation of removing bubbles and solids in the ink from the head unit, the ink tank is pressurized by driving an air pump, the ink is supplied from the ink tank to each head unit through a circulation going path, a part of ink which is not discharged from each head unit is stored in the sub-tank through a circulation returning path. The ink which is temporarily stored in the sub-tank after the purge operation is ended is returned to the ink tank and is reused.

The ink circulation printer described in JP-A-11-342634 is configured so that at the time of cleaning, a part of the ink which is not discharged from each head unit flows back to the sub-tank through the circulation return path, bubbles and the like included in the ink in the printing head are removed by the circulating ink flow, and it can be expected that they are recovered in the sub-tank.

In this case, the cleaning effect of removing the bubbles can be improved by raising the flow velocity of the ink flowing in the printing head. In order to raise the ink flow velocity, it is necessary to improve the capability of a pressurization pump. Accordingly, there is a problem that it is difficult to obtain a good cleaning effect in proportion to the capability of the pump. In the printer described in JP-A-11-342634, since the ink is also discharged from nozzles, and a flow rate of the ink flowing toward the circulation return path in the printing head is decreased as much as the amount of ink used for discharge from the nozzles as compared with the flow rate of the ink supplied to the printing head, thus there is a problem that effective cleaning cannot be expected.

Since nozzle cleaning of compulsorily discharging the ink from the nozzles of the printing head is performed by circulating the ink, it is impossible to sufficiently raise the pressure of the ink in the printing head by flowing back the ink, and it is difficult to strongly discharge the ink from the nozzles.

Particularly, in the case of using ink with a relatively high viscosity as compared with aqueous ink, such as UV (Ultra Violet) ink (ultraviolet ray curable ink) cured by irradiation of ultra violet rays, it is necessary to make an ink flux strong to that extent to perform cleaning, but such a method is not disclosed. For this reason, in order to improve the cleaning effect, it is necessary to provide a large apparatus exclusively for cleaning.

SUMMARY OF INVENTION

An advantage of some aspects of the invention is to provide a liquid ejecting apparatus which can effectively perform cleaning in a configuration of supplying liquid from a tank to a plurality of liquid ejecting heads, and a method of cleaning the liquid ejecting heads of the liquid ejecting apparatus.

According to an aspect of the invention, there is provided a liquid ejecting apparatus provided with N (N≥2) liquid ejecting heads which eject liquid, the liquid ejecting apparatus including: a supply path through which liquid is supplied from a tank to the N liquid ejecting heads; a circulation path through which liquid is returned from the liquid ejecting heads to the tank; N opening and closing valves that are installed for each liquid ejecting head on at least one of the supply path and the circulation path; and a liquid sending unit that applies a force sending the liquid from the tank toward the liquid ejecting heads, wherein M opening and closing valves corresponding to M (M<N) liquid ejecting heads selected as cleaning targets are selected to be opened among the N opening and closing valves and the liquid sending unit is driven, to selectively send liquid to the M liquid ejecting heads of the cleaning targets among the N liquid ejecting heads, thereby performing cleaning.

With such a configuration, the M opening and closing valves corresponding to the M liquid ejecting heads selected as the cleaning targets are selected to be opened among the N opening and closing valves installed on the circulation path, and the liquid sending unit is driven to apply a force sending the liquid from the tank to the liquid ejecting heads, to send the liquid to the M liquid ejecting heads of the cleaning targets, thereby selectively performing the cleaning. In this case, as a result of the opening or closing selection of the opening and closing valve, the liquid sent by the liquid sending unit intensively flows into the M liquid ejecting heads of the cleaning targets, and thus it is possible to obtain a good cleaning effect.

In the liquid ejecting apparatus, it is preferable that the liquid sending unit is provided with a supply pump installed on the supply path, and the supply pump is driven in a state where the opening and closing valve corresponding to the liquid ejecting head of the cleaning target is opened.

According to the aspect of the invention, since the pump is driven with the M opening and closing valves opened, the liquid flows to be discharged (reflow) from the supply path to the circulation path through the inside of the M liquid ejecting heads corresponding to the opened opening and closing valves, and the cleaning of removing bubbles and the like in the liquid ejecting heads is performed by the flow. In this case, the liquid does not flow into all the N liquid ejecting heads, but intensively flows into only a part of the (M) liquid ejecting heads, the flow rate is increased, and it is possible to obtain a good cleaning effect.

In the liquid ejecting apparatus, it is preferable to further include a depressurization unit that depressurizes the inside of the tank, and the depressurization unit is driven to make the inside of the tank into a negative pressure at the time of performing the cleaning.

According to the aspect of the invention, since the inside of the tank is made into the negative pressure by driving the depressurization unit at the time of cleaning, at least a part of the increase of liquid pressure in the liquid ejecting heads caused by the increase of a flow rate is offset by the negative pressure of the tank even when the flow rate of the liquid flowing in the liquid ejecting heads of the cleaning targets is increased. Accordingly, it is possible to prevent or suppress leakage of liquid from the nozzles which is likely to occur due to the increase of the liquid pressure caused by the increase of the flow rate in the liquid ejecting heads at the time of cleaning. In addition, since bubbles get larger by depressurizing the inside of the liquid ejecting heads, it is easy to remove the bubbles by the flow of the liquid. Therefore, it is possible to perform the cleaning with a high effect while suppressing the leakage of liquid from the nozzles as much as possible.

In the liquid ejecting apparatus, it is preferable that the liquid sending unit is further provided with a pressurization pump that pressurizes the tank, a cutoff unit capable of temporarily cutting off flow of liquid from the tank to the liquid ejecting head is installed at a part other than the side, on which the N opening and closing valves are installed, in the supply path and the circulation path, the pressurization pump is driven in a state where the cutoff unit is cut off and the N opening and closing valves are closed such that the tank is in a pressurization state, and at least one opening and closing valve corresponding to the liquid ejecting heads of the cleaning targets is opened to discharge liquid from the nozzles of at least one liquid ejecting head corresponding to the opened opening and closing valves.

According to the aspect of the invention, in a state where a cutoff unit installed at the part other than the side, on which the N opening and closing valves are installed, in the supply path and the circulation path, is cut off and the N opening and closing valves are closed, the pressurization pump is driven such that the tank is made into a pressurization state (compression state), and at least one opening and closing valve corresponding to at least one liquid ejecting head of the cleaning targets is opened. As a result, the pressurized (compressed) liquid is supplied to at least one liquid ejecting head of the cleaning target at once, and the liquid is strongly discharged from the nozzles thereof. Liquid thickening materials or dust (paper powder, etc.) in the nozzles are removed by the discharge of the liquid, and nozzle clogging is dissolved or prevented. In this configuration, the cleaning may be performed for all the liquid ejecting heads as the cleaning targets, and the cleaning may be performed only for the selected M liquid ejecting heads less than N.

In the liquid ejecting apparatus, it is preferable that the N opening and closing valves are installed on the circulation path, the supply pump is driven in a state where the N opening and closing valves are closed to send liquid to the N liquid ejecting heads, and the liquid is sent to the N liquid ejecting heads to discharge the liquid from the nozzles of the N liquid ejecting heads, thereby performing cleaning.

According to the aspect of the invention, the supply pump is driven with the N opening and closing valves closed, and the liquid is sent to the N liquid ejecting heads to discharge the liquid from the nozzles of the N liquid ejecting heads, thereby performing the cleaning. Liquid thickening materials or dust (paper powder, etc.) in the nozzles of the liquid ejecting head are removed by the cleaning, and nozzle clogging is dissolved or prevented.

In the liquid ejecting apparatus, it is preferable that the liquid sending unit is a pressurization unit that pressurizes the tank, a cutoff unit capable of temporarily cutting off the flow of liquid from the tank to the liquid ejecting head is installed at the part other than the side, on which the N opening and closing valves are installed in the supply path and the circulation path, the pressurization unit is driven in a state where the cutoff unit is cut off and the N opening and closing valves are closed such that the tank is made into a pressurization state, and the M opening and closing valves corresponding to the liquid ejecting heads of the cleaning targets are opened to discharge liquid from the nozzles of the M liquid ejecting heads corresponding to the opened opening and closing valves.

According to the aspect of the invention, in a state where a cutoff unit installed at the part other than the side, on which the N opening and closing valves are installed, in the supply path and the circulation path is cut off and the N open and close valves are closed, the pressurization unit is driven such that the tank is made into a pressurization state (compression state), and the M opening and closing valves corresponding to the liquid ejecting head of the cleaning targets are opened. As a result, the pressurized (compressed) liquid is supplied to the M liquid ejecting heads of the cleaning target at once, and the liquid is strongly discharged from the nozzles thereof. Liquid thickening materials or dust (paper powder, etc.) in the nozzles are removed by the discharge of the liquid, and nozzle clogging is dissolved or prevented.

According to another aspect of the invention, there is provided a method of cleaning liquid ejecting heads of a liquid ejecting apparatus provided with N ($N \geq 2$) liquid ejecting heads which eject liquid, a supply path through which liquid is supplied from a tank to the liquid ejecting heads, and a circulation path through which liquid is returned from the liquid ejecting heads to the tank, wherein M opening and closing valves corresponding to M ($M<N$) liquid ejecting heads selected as cleaning targets among N opening and closing valves installed for each liquid ejecting head on at least one of the supply path and the circulation path are selected to be opened, and a liquid sending unit applying a force sending the liquid from the tank toward the liquid ejecting heads is driven, to selectively send liquid to the M liquid ejecting heads selected as the cleaning targets among the N liquid ejecting heads, thereby performing cleaning. According to the aspect of the invention, it is possible to obtain the same effect as that of the first aspect of the invention.

BRIEF DESCRIPTION OF THE DRAWINGS

The invention will be described with reference to the accompanying drawings, wherein like numbers reference like elements.

DESCRIPTION OF THE PREFERRED EMBODIMENTS

Hereinafter, an embodiment of the invention will be described with reference to FIG. 1 to FIG. 11.

Figure 1:
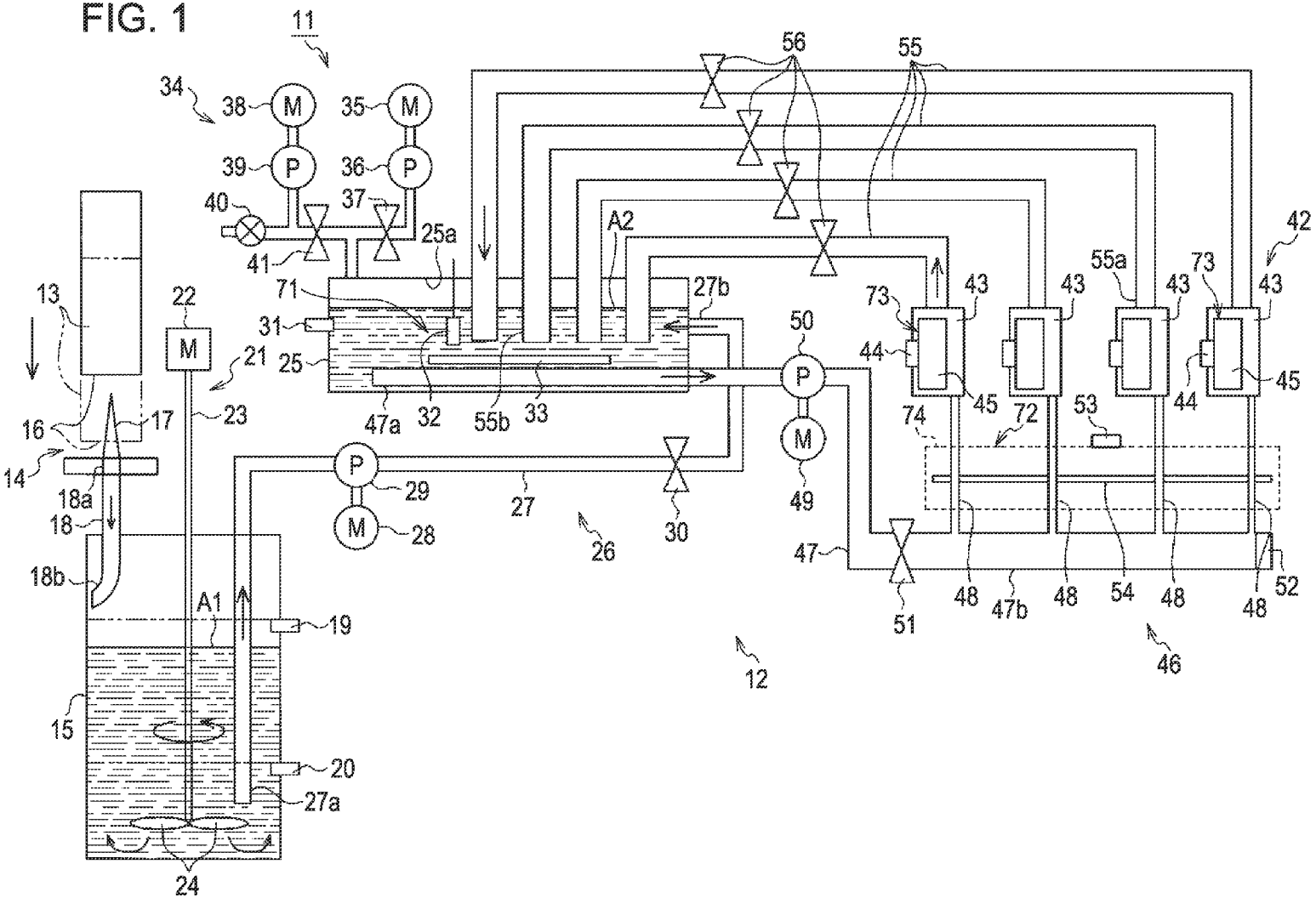
FIG. 1 is a schematic view illustrating a printer according to an embodiment of the invention.

As shown in FIG. 1, an ink jet printer (hereinafter, referred to as "printer 11") as a liquid ejecting apparatus is provided with a printing portion 12 performing a printing process on a target (not shown) (film, etc.) using UV (Ultra Violet) ink (ultra violet curable ink) as an example of a liquid. The printer 11 of the embodiment is provided with an irradiation portion (not shown) irradiating the target printed by the printing portion 12 with an ultraviolet ray to harden the UV ink attached to the target. The UV ink contains a pigment component with low dispersion stability, and has a property that the pigment component is easily precipitated.

The printing portion 12 is provided with a holder portion 14 on which an ink cartridge 13 storing the UV ink is mounted, and a substantially bottomed cylindrical main tank 15 is disposed under the holder portion 14 in the gravity direction. The holder portion 14 is provided with a hollow ink supply needle 17 which can be attached to and detached from a leading portion 16 of the ink cartridge 13 disposed at a mount position indicated by a chain double dashed line shown in FIG. 1. The holder portion 14 is connected to a first ink supply pipe 18, an upstream end 18*a* of which communicates with the inside of the ink supply needle 17, and a downstream end 18*b* of the first ink supply pipe 18 is disposed in the main tank 15. The main tank 15 is configured such that the permissible accommodation amount of the UV ink is sufficiently larger than the storage amount of the UV ink in the ink cartridge 13. A side wall of such a main tank 15 is provided with a plurality (2 in the embodiment) of main residual amount sensors 19 and 20 for detecting a residual amount of the UV ink in the main tank 15 on the basis of the position of a liquid surface A1 of the UV ink, and the main residual amount sensors 19 and 20 are disposed at positions different from each other in the gravity direction.

The printing portion 12 is provided with a stirring device 21 for stirring the UV ink accommodated in the main tank 15. The stirring device 21 is provided with a stirring motor 22 as a driving source, a shaft member 23 rotated by driving the stirring motor 22, and a plurality of fan members 24 installed at a leading end (lower end in FIG. 1) of the shaft member 23.

The printing portion 12 is provided with a sub-tank 25 as a tank with a permissible accommodation amount of the UV ink smaller than that of the main tank 15, and a first liquid supply portion 26 for supplying the UV ink from the main tank 15 into the sub-tank 25. The first liquid supply portion 26 is provided with a second ink supply pipe 27 having an upstream end 27*a* disposed in the main tank 15 and a downstream end 27*b* connected to the sub-tank 25, and a first pump 29 that absorbs the UV ink in the main tank 15 by driving a first driving motor 28 and discharges the UV ink to the sub-tank 25. A first opening and closing valve (e.g., electronic valve) 30 operable to allow and restrict the UV ink to flow between the tanks 15 and 25 is installed closer to the sub-tank 25 than the first pump 29 in the second ink supply pipe 27.

The sub-tank 25 has a tank body constituting a bottomed cylinder, and a cover portion covering an opening portion of the tank body. The side wall of such a sub-tank 25 is provided with a sub-residual sensor 31 for detecting an accommodation amount of the UV ink temporarily accommodated in the sub-tank 25. When a liquid surface A2 of the UV ink in the sub-tank 25 is positioned in the same position as the installation position of the sub-residual sensor 31 or above the installation position, an ON signal is output from the sub-residual sensor 31. The sub-tank 25 is provided with a first temperature sensor 32 for detecting a temperature of the UV ink in the sub-tank 25, and a sub-tank heater 33 for heating the UV ink. The sub-tank 25 is connected to a pressurization and depressurization device 34 for pressurizing and depressurizing the inside of the sub-tank 25.

The pressurization and depressurization device 34 is provided with a second pump 36 pumping gas into the sub-tank 25 by a second driving motor 35 to pressurize the inside of the sub-tank 25, and a second opening and closing valve (e.g., electronic valve) 37 which is opened when the second pump 36 is driven and is closed when the second pump 36 is not driven. The pressurization and depressurization device 34 is provided with a third pump 39 discharging gas from the sub-tank 25 by a third driving motor 38 to depressurize the inside of the sub-tank 25, and a pressure open valve 40 for opening to the air until the pressure of the inside of the sub-tank 25 is raised to a set pressure. The pressurization and depressurization device 34 is provided with a third opening and closing valve (e.g., electronic valve) 41 which is opened when at least one of the third pump 39 and the pressure open valve 40 is driven and is closed when neither the third pump 39 nor the pressure open valve 40 are driven.

The printing portion 12 is provided with an ink ejecting unit 42 that ejects the UV ink to a target, and the ink ejecting unit 42 has a plurality (4 in the embodiment) of printing heads (liquid ejecting heads (liquid ejecting means)) 43. The printing heads 43 appropriately eject the UV ink supplied to the inside, from each nozzle thereof. Each printing head 43 is respectively provided with a second temperature sensor 44 for detecting a temperature of the UV ink supplied to the inside, and a head heater 45 for keeping the heat of the UV ink therein.

The UV ink in the sub-tank 25 is respectively supplied to each printing head 43 through the second liquid supply portion 46. The second liquid supply portion 46 is provided with a third ink supply pipe 47 (supply path), an upstream end 47*a* of which is disposed in the vicinity of the bottom of the sub-tank 25. The third ink supply pipe 47 has one upstream side common pipe 47*b* (common path), and a plurality (4 in the embodiment) of connection pipes 48 (connection path) branched parallel from the common pipe 47*b*, installed on the downstream side to be connected to the printing heads 43, and corresponding to the printing heads 43, respectively. The third ink supply pipe 47 is provided with a fourth pump 50 that absorbs the UV ink from the sub-tank 25 by driving a fourth driving motor 49 and discharges the UV ink to the printing heads 43. A fourth opening and closing valve (e.g., electronic valve) 51 operable to allow or restrict the UV ink to flow from the sub-tank 25 to the printing heads 43, and a damper 52 for damping pulsation of the UV ink supplied by the fourth pump 50 are installed closer to the printing heads 43 than the fourth pump 50 in the third ink supply pipe 47. Reciprocal pumps such as diaphragm pumps, pipe pumps, piston pumps, and plunger pumps, and rotary pumps such as gear pumps, vane pumps, and screw pumps may be used as the first to fourth pumps.

The connection pipes 48 are respectively configured such that flow path cross sections S2 thereof are narrower than a flow path cross section S1 of the common pipe 47*b*. The UV ink flowing in the connection pipes 48 is heated by a supply path heater 54 controlled on the basis of a detection signal from a third temperature sensor 53.

A plurality (4 in the embodiment) of ink circulation pipes 55 corresponding to the printing heads 43, respectively, are installed between the printing heads 43 and the sub-tank 25. The ink circulation pipes 55 are respectively configured such that upstream ends 55*a* thereof are connected to the printing heads 43 and downstream ends 55*b* thereof are disposed in the sub-tank 25. The ink circulation pipes 55 are configured such that flow path cross sections S3 thereof are narrower than the flow path cross section S1 of the common pipe 47*b* and are wider than the flow path cross sections S2 of the connection pipes 48 (S1>S3>S2). Each ink circulation pipe 55 configured in this way is respectively provided with a fifth opening and closing valve (e.g., electronic valve) 56 operable to allow and restrict the UV ink to flow from the printing head 43 to the sub-tank 25.

The printing portion 12 is provided with a transport unit (not shown) for transporting a target, and the printing heads 43 eject the UV ink to the target transported by the transport unit, thereby performing printing. The transport unit is provided with a known transport mechanism such as a roller transport mechanism, a belt transport mechanism, and a rotation drum transport mechanism, and a transport motor 57 (see FIG. 2). The transport mechanism is driven by the driving force of the transport motor 57 (see FIG. 2) such that the transport unit transports the target.

The printer 11 configured as described above operates as follows. The ink cartridge 13 is disposed at a waiting position where the ink supply needle 17 is not inserted into the leading portion 16 thereof. When the liquid surface A1 of the UV ink in the main tank 15 descends and the first main residual sensor 19 on the upside is turned off from the on state, an attachable and detachable motor is driven on the basis of an instruction from a control device 60 to be described later, a press member of a pressing device (not shown) disposed above the holder portion 14 moves down the ink cartridge 13 disposed at the waiting position against the bias force of a biasing unit. As a result, the ink cartridge 13 is disposed at a mount position where the ink supply needle 17 is inserted, and is mounted on the holder portion 14. The UV ink in the ink cartridge 13 is led to the main tank 15 through the ink supply needle 17 and the first ink supply pipe 18. At this time, the UV ink is stirred for a predetermined time by the stirring device 21 in the main tank 15.

The control device 60 of the printer 11 measures ink consumption in the printing heads 43. When the control device 60 determines that the UV ink in the sub-tank 25 is consumed by a predetermined amount from the liquid surface A2 state where the sub-residual sensor 31 is turned on, on the basis of the measurement result, the first pump 29 is driven to supply the UV ink from the main tank 15 to the sub-tank 25. When the liquid surface A2 of the UV ink in the sub-tank 25 ascends and the sub-residual sensor 31 is turned on from the off state, the control device 60 stops driving the first pump 29 to stop the supply of the UV ink from the main tank 15 to the sub-tank 25.

At the time of printing, the fourth pump 50 is driven by the pressurization and depressurization device 34 while depressurizing the sub-tank 25, the UV ink is supplied from the sub-tank 25 to the printing head 43 through the third ink supply pipe 47, and the ink flows back from the printing head 43 to the sub-tank 25 through the ink circulation pipe 55. The ink is supplied to the printing heads 43 by the circulation of ink performed through the third ink supply pipe 47 and the ink circulation pipe 55 between the sub-tank 25 and the printing heads 43. The ink is consumed to the extent that the ink ejected from the nozzles by the printing heads 43 is gradually decreased in the sub-tank 25.

In the printer 11, the UV ink in the sub-tank 25 and the third ink supply pipe 47 is heated by the sub-tank heater 33 and the supply path heater 54, and a temperature control is performed such that the temperature of the heated and supplied UV ink in the printing head 43 is maintained by the head heater 45. In the printer 11, first cleaning of removing bubbles in the ink in the printing heads 43, and second cleaning of preventing and dissolving the clogging of the nozzles of the printing heads 43 are performed.

The printing portion 12 can eject UV ink with various colors to a target, and is provided with a printing unit including the holder portion 14, the tanks 15 and 25, and the ink ejecting unit 42 for each color. However, in the embodiment, only the printing unit for one color (e.g., white) is described, and the description of the printing units for other colors is not repeated for convenience of description and understanding of the specification. In the following description, the UV ink may be referred to as ink.

Figure 2:
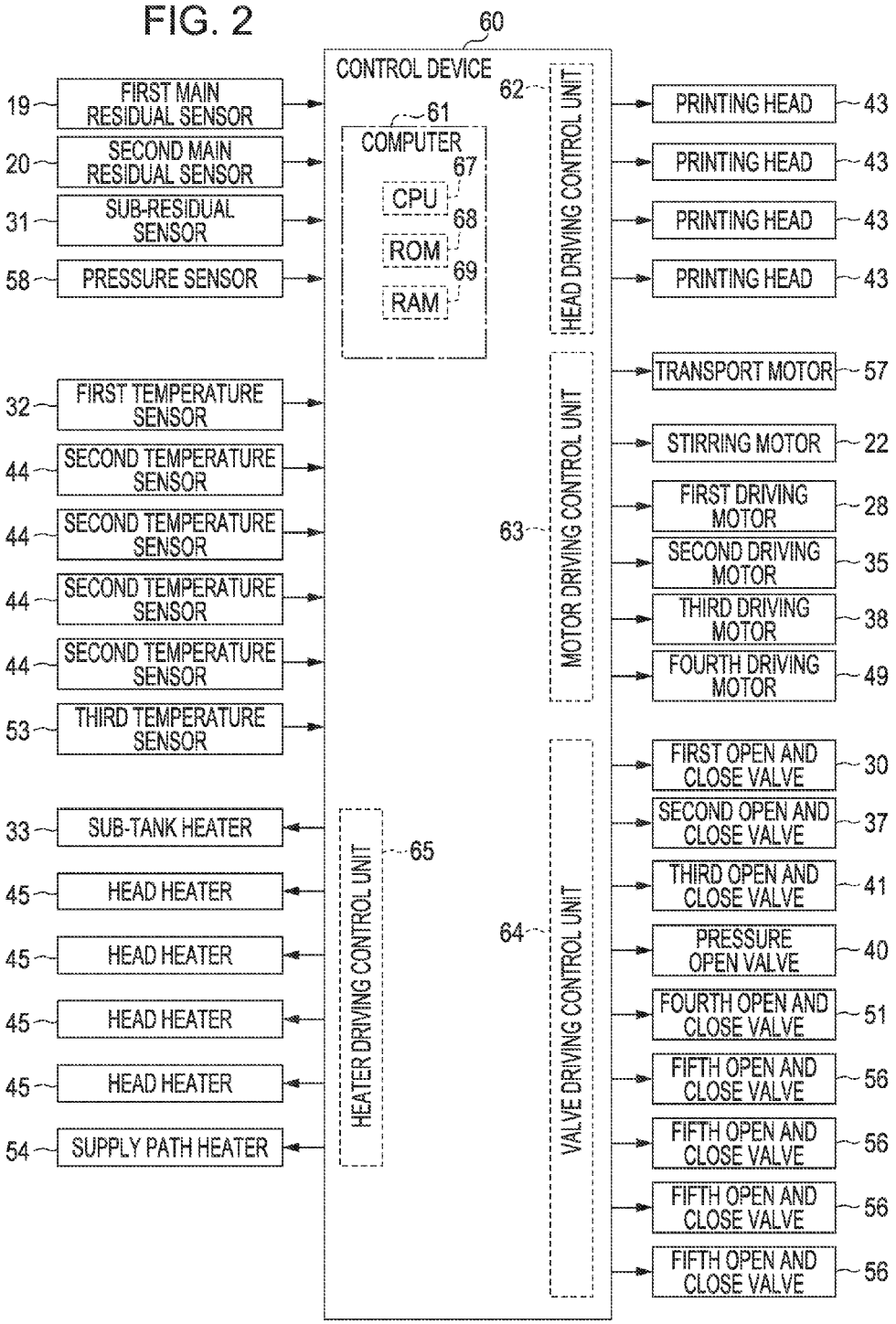
FIG. 2 is a block diagram illustrating an electrical configuration of the printer.

An electrical configuration of the printing portion 12 of the embodiment will be described with reference to FIG. 2. As shown in FIG. 2, the printer 11 is provided with the control device 60 generally controlling an ink supply system and a printing system. An input and output interface of the control device 60 is electrically connected to the first main residual sensor 19, a second main residual sensor 20, a sub-residual sensor 31, and a pressure sensor 58 detecting an air pressure in the sub-tank 25, respectively, as sensors of the ink supply system. The input and output interface is electrically connected to the first temperature sensor 32, the four second temperature sensors 44, and the third temperature sensor 53, as heating control sensors.

The input and output interface of the control device 60 is electrically connected to the four printing heads 43, and the transport motor 57, respectively, as control targets of the printing system. The input and output interface is respectively electrically connected to the first driving motor 28, the second driving motor 35, the third driving motor 38, and the fourth driving motor 49 for driving pumps as control targets of the ink supply system, the first opening and closing valve 30, the fourth opening and closing valve 51, the four fifth opening and closing valves 56, and the second opening and closing valve 37, the third opening and closing valve 41, and the pressure open valve 40 for opening and closing the flow paths, which constitute the pressurization and depressurization device 34.

The input and output interface of the control device 60 is electrically connected to the sub-tank heater 33 for heating ink, the supply path heater 54 for heating ink, and the four head heaters 45 for keeping the heat of ink, respectively.

The control device 60 is provided with a computer 61 (microcomputer) performing various controls on the basis of the detection results and the like input from the sensors 19, 20, 31, 32, 44, 53, and 58, a head driving control unit 62 controlling the printing heads 43 to be driven, a motor driving control unit 63 controlling the motors 57, 22, 28, 35, 38, and 57 to be driven, a valve driving control unit 64 controlling the opening and closing valves 30, 37, 41, 51, and 56, and the pressure open valve 40, and a heater driving control unit 65 controlling the heaters 33, 45, and 54 to perform heating.

The control device 60 controls a printing operation, a transport operation, a pumping operation, a valve driving operation, a heating operation, and the like by giving an instruction (instruction value) to the driving control units 62 to 65 by a computer 61. The computer 61 is provided with a CPU 67, a ROM 68, and a RAM 69. Program data for various controls performed by the CPU 67 and various data including setting values and the like used for various controls are stored in the ROM 68. Operation results and the like of the CPU 67 are temporarily stored in the RAM 69. A part of an area of the RAM 69 is used as, for example, a buffer for developing printing data input from a host device (not shown). The driving control units 62 to 65 are configured by an ASIC (Application Specific Integrated Circuit) and various driving circuits. A plurality of CPUs 67 controlling the printing system (transport system, ejection system), the ink supply system, and the heating system, respectively, may be installed.

For example, the computer 61 instructs a duty value D corresponding to the amount of ejected ink to the head driving control unit 62, and thereby performs a duty control of controlling the amount of ink ejected from the nozzles of the printing heads 43. In this case, the duty value D instructed by the computer 61 is varied in the range of 0 to 100%, and the amount of ejected ink (=1 the amount of ink discharged per ejection) is increased substantially in proportion to the increase of the duty value (%). When ink droplets are ejected for every ejection period from all the nozzles to all the printing heads 43 by instructing the duty value 100% (FULL duty), the amount of ink discharged per unit time (ink ejection flow rate Qh) discharged by the ejection from the nozzles of the printing heads 43 is the maximum.

In the printer 11 of the embodiment, first cleaning of removing bubbles in the ink in the printing head 43 by ink circulation flow, and second cleaning (nozzle cleaning) of compulsorily discharging ink from the nozzles 84 (see FIG. 8) of the printing head 43 to prevent and dissolve the nozzle clogging are performed.

For example, at the time of cartridge replacement of replacing an emptied ink cartridge 13 with another ink cartridge 13 of the same ink (i.e., the same color), bubbles may be mixed into the ink through the ink supply needle 17 when the holder portion 14 is loaded with the ink cartridge 13. At the time of replacing the ink cartridge 13 with another ink cartridge 13 of a different ink (i.e., a different color), all the ink in the tank and the flow path is replaced and an initial charging process of charging the replaced ink to the flow path is performed. For example, at a part where a resin pipe is used among the ink supply pipes 18, 27, and 47, and the ink circulation pipe 55, air permeating the resin pipe and dissolving into the ink in the flow path may turn into bubbles during a long period in which the printer 11 is not used. As described above, at the time of cartridge replacement, initial charging, and long term printer non-use, the bubbles may be collected in the corner of an area on a more upstream side than a filter 83 (see FIG. 8) in the printing head 43 or the bubbles may be caught by the filter 83. For this reason, the first cleaning is performed using the ink circulation flow, mainly to remove the bubbles in the ink in the main printing head 43. That is, the computer 61 shown in FIG. 2 performs the first cleaning at the time of detecting the cartridge replacement, at the time of detecting the initial charging, or when a count time T of an internal timer that counts the time elapsed from the time point of the completion of the previous second cleaning until it reaches a first cleaning time T1.

The second cleaning for preventing and dissolving the nozzle clogging of the printing head 43 is performed when cleaning is instructed to be performed by an operation of a user or when it is time to perform the cleaning. That is, the computer 61 shown in FIG. 2 performs the second cleaning when the cleaning is instructed to be performed by the operation of a user or when the count time T of the internal timer that counts the time elapsed from the time point of the completion of the previous second cleaning until it reaches a second cleaning time T2.

The second pump 36 (pressurization pump) is driven, an air chamber 25*a* in the sub-tank 25 is pressurized, the ink in the sub-tank 25 is pressurized, the ink is pressurized and supplied from the sub-tank 25 to the printing head 43 through the ink circulation pipe 55, and the ink is compulsorily discharged from the nozzles of the printing head 43, whereby the second cleaning is performed. For this reason, the second cleaning is performed in 2 steps of a step (pressurization step) of closing the flow path of the ink circulation pipe 55 to pressurize the ink pressure on the upstream side including the sub-tank 25, and a step (valve opening step) of opening the flow path of the ink circulation pipe 55 at the time point when the ink pressure is pressurized up to a target value to allow the pressurized ink to flow to the downstream side at once, to compulsorily discharge the ink from the nozzles 84.

That is, in the pressurization step of the second cleaning, the opening and closing valves 30, 41, 51, and 56 are closed, the opening and closing valve 37 is opened, the driving of the pumps 29, 39, and 50 is stopped, the second pump 36 (pressurization pump) is driven, thereby pressurizing the ink in the sub-tank 25.

In the embodiment, M ($1 \leq M < N$) printing heads 43 to be subjected to the second cleaning are selected from all the (N) printing heads 43, and selective cleaning of performing the cleaning only on the selected M printing heads 43 is employed. The printer 11 is provided with a nozzle examining device (not shown) capable of examining the nozzle clogging for each printing head 43, and the printing head 43, for which the result of the examination that the cleaning is necessary was obtained by the nozzle examining device, becomes a cleaning target.

For example, a plurality of strength levels is prepared in the second cleaning. When the second cleaning is repeatedly instructed by the operation of a user, stronger cleaning is selected according to an increase in the number of operations, and stronger cleaning is selected to the extent that the time elapsed from the time point of performing the previous cleaning is long. In the pressurization step, the control device 60 starting the driving of the second pump 36 detects pressure (air pressure) of the air chamber 25*a* by the pressure sensor 58, and determines that the pressurization step is completed when the detected pressure reaches a target pressure corresponding to the strength of the selected cleaning strength. After the completion of the pressurization step, only the opening and closing valve 56 on the ink circulation pipe 55 communicating with the M printing heads 43 for which it is determined that the cleaning is necessary on the basis of the nozzle examination result is opened among the N opening and closing valves 56, and the second cleaning is performed only on the M printing heads 43 (valve opening step).

In the embodiment, the flow path resistance of the third ink supply pipe 47 and the ink circulation pipe 55 is set as follows. The flow path resistance R ($\approx R2 > R1$) of the third ink supply pipe 47 (supply path) and the flow path resistance R3 of the ink circulation pipe 55 (circulation path) are set to satisfy the relation of $R < R3$. For this reason, the flow rates of ink supplied to the printing heads 43 can be made substantially equal, and it is possible to keep the ink pressure in the printing heads 43 low while suppressing the difference of ink pressure among the printing heads 43 to a minimum. By this configuration, the ink pressure of the printing heads 43 falls within a permissible range, and a proper quantity of ink droplets can be ejected while suppressing ink leakage from the printing heads 43 during the printing.

The flow path resistance R1 of the common pipe 47*b* of the third ink supply pipe 47, the flow path resistance R2 of the connection pipe 48, and the flow path resistance R3 of the ink circulation pipe 55 are set to satisfy the relation of R1<R3<R2. By this configuration, the flow rates of the ink supplied to the printing heads 43 can be made substantially equal, the ink pressure in the printing heads 43 can be kept low while suppressing the difference of ink pressure among the printing heads 43.

The flow path resistance R1 of the common pipe 47*b* among the flow path resistances R1, R2, and R3 can be minimized, and the flow path resistance R2 of the connection pipe 48 is maximized. Accordingly, the ink pressure in the inlets of the connection pipes 48 on the common pipe 47*b* can be made substantially equal, and the flow rates of the ink supplied to the printing heads 43 can be made substantially equal since the flow path resistance R2 of the connection pipes 48 is very high. The ink pressure in the printing head 43 tends to increase to the extent that the flow path resistance R3 of the ink circulation pipe 55 is large. However, it is possible to keep the ink pressure in the printing head 43 low since the flow path resistance R3 of the ink circulation pipe 55 is made low. In this case, the ink supply flow rate Qin is substantially the same among the printing heads 43, the ink ejection flow rate Qh is different among the printing heads 43, and thus the ink circulation flow rate Qout (=Qin−Qh) is different among the printing heads 43. However, a pressure loss P3loss (=Qout·R3) of the ink circulation pipe 55 represented by a product of the ink circulation flow rate Qout and the flow path resistance R3 becomes a small value, since the flow path resistance R3 of the ink circulation pipe 55 is minimized. For this reason, the value of the pressure loss P3loss can be considered as substantially the same among the printing heads 43, and thus it is possible to make the ink pressure in the printing heads 43 substantially equal among the printing heads 43.

The flow path resistance R1 of the common pipe 47*b* and the flow path resistance R3 of the ink circulation pipe 55 satisfy the relation of R1<R3 such that, even though the flow path resistance R3 of the ink circulation pipe 55 is required to be as low as possible, a diameter of the ink circulation pipe 55 is reduced to the extent that the ink circulation flow rate Qout is less than the ink supply flow rate Qin due to the ink being ejected and consumed by the printing heads 43, at least at the time of printing, in order to miniaturize the ink circulation pipe 55. In the printing head 43, fluctuation of the ink pressure is required to fall within ±50 Pa. For this reason, the flow path resistance R3 of the ink circulation pipe 55 is determined such that the fluctuation of the ink pressure in the printing head 43 falls within ±50 Pa, in the range where the ink circulation flow rate Qout is changed between the maximum printing and the non-printing.

Since the fluctuation of the ink pressure is required to fall within ±50 Pa regardless of the printing mode, the flow path resistance R2 of the connection pipe 48 is set to satisfy the relation that it is five times or more (R2≥5·R3) than the flow path resistance R3 of the ink circulation pipe 55. For this reason, the fluctuation of the ink pressure in the printing head 43 falls within ±50 Pa whenever the printing is performed regardless of the printing mode, and it is possible to stabilize the amount of ink ejected from the nozzles of the printing head 43.

Figure 3:
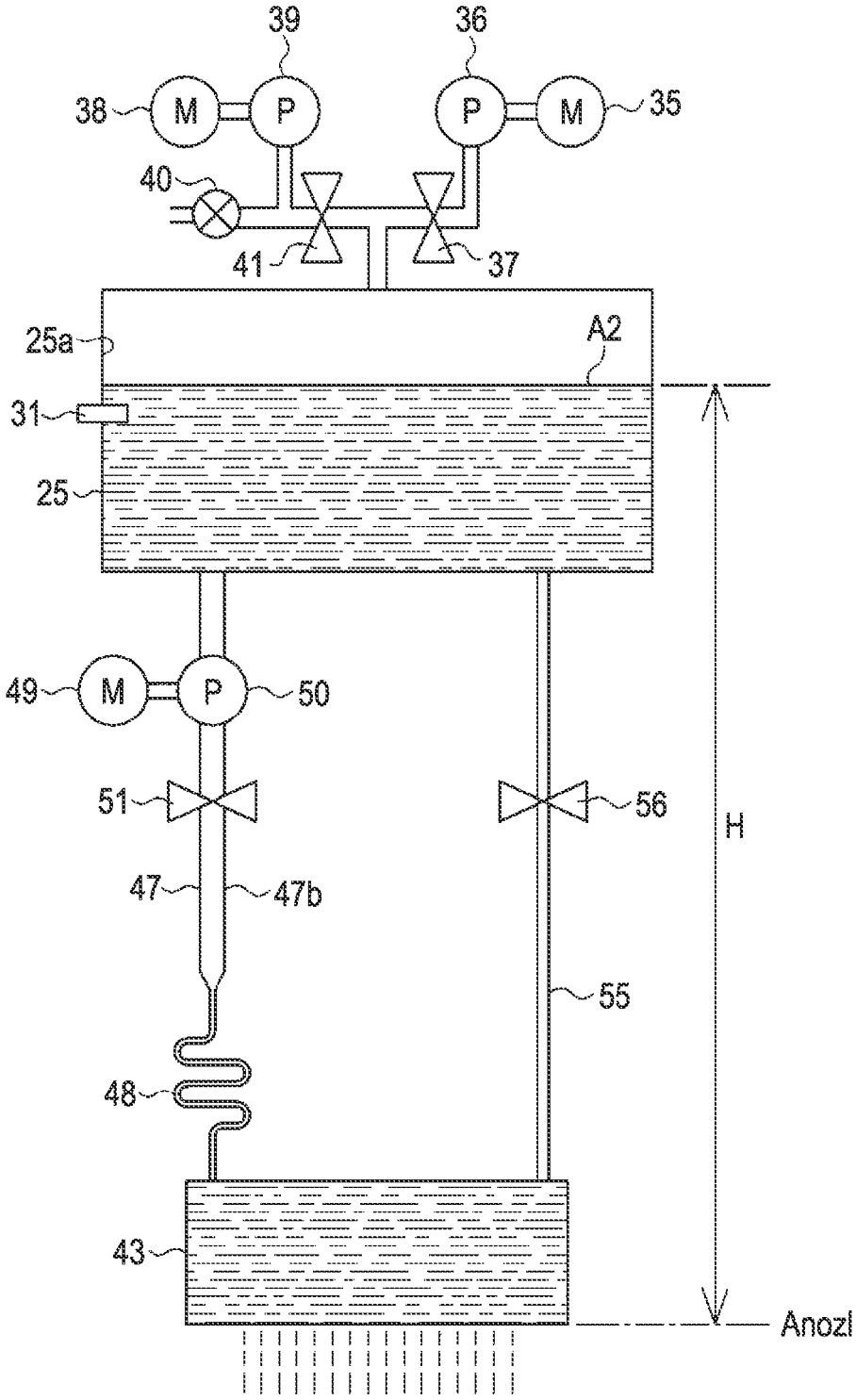
FIG. 3 is a schematic side view illustrating an ink supply system including a sub-tank and a printing head.

FIG. 3 is a schematic view illustrating the ink supply system including the sub-tank and the printing head. As shown in FIG. 3, the sub-tank 25 is disposed above the printing head 43 in the gravity direction. In the embodiment, the printing head 43 is not provided with a pressure adjustment valve therein. For this reason, the ink pressure at the nozzles 84 in the printing head 43 is adjusted using a liquid head difference H that is a gravity direction distance between a height of the liquid surface A2 in the sub-tank 25 and an ink meniscus surface height Anozl in the nozzles of the printing head 43.

The ink pressure at the nozzles 84 in the printing head 43 is affected by the flow path resistance of the ink flowing in the flow path including the third ink supply pipe 47, the ink circulation pipe 55 and the ink pressure in the sub-tank 25, and the like, as well as the liquid head difference H between the liquid surface A2 in the sub-tank 25 and the ink meniscus surface height Anozl in the nozzles. For this reason, in the embodiment, the air chamber 25*a* in the sub-tank 25 is controlled into negative pressure by the pressurization and depressurization device 34 to make the ink pressure in the sub-tank 25 into negative pressure, thereby performing a control of adjusting the ink pressure in the ink meniscus in the nozzles 84 of the printing head 43 to a proper value.

The printing head 43 is provided with a pressure chamber (not shown) communicating with the nozzles 84 (see FIG. 8) for each nozzle. When a pressure generating element disposed for each nozzle on the side opposite to the nozzles with respect to the pressure chamber is driven, the pressure chamber is expanded and contracted, and the ink absorbed into the pressure chamber at the time of expanding is ejected from the nozzles 84 at the time of contracting. In this case, the ink meniscus surface height Anozl in the nozzles 84 is determined by the ink pressure (i.e., ink pressure on reaching the nozzles) of the pressure chamber. Keeping the ink meniscus surface height Anozl at a proper position in the nozzles 84 is a condition of keeping the ink ejection performance stable. For example, when the ink pressure of the pressure chamber is too low and the ink meniscus surface in the nozzles 84 is located in the nozzles, a shortage in the amount of ink ejected or ejection mistakes easily occur. When the ink pressure of the pressure chamber is too high and the ink meniscus surface in the nozzles is located to protrude in an arc surface shape from opening of the nozzles, the amount of ejected ink becomes excessive or ink leakage from the nozzles occurs. For this reason, in the embodiment, an ink supply control is performed to maintain the ink pressure of the ink meniscus at a proper value.

Hereinafter, the ink supply control will be described with reference to FIG. 3. The flow path resistance of the common pipe 47*b* is R1, the flow path resistance of the connection pipe 48 is R2, the flow path resistance of the ink circulation pipe 55 is R3, the liquid head difference between the liquid surface A2 of the ink in the sub-tank 25 and the ink meniscus surface height Anozl in the nozzles is H (liquid surface height difference), and the negative pressure value in the sub-tank 25 is Pdec (depressurization value).

In the example, the supply flow rate from the fourth pump 50 (supply pump) is fixed at 20 N(cc/min). A pressure based on the liquid head difference H is P(H), a pressure loss based on the flow path resistance R1 of the common pipe 47*b* is P1loss, a pressure loss based on the flow path resistance R2 of the connection pipe 48 is P2loss, and a pressure loss based on the flow path resistance R3 of the ink circulation pipe 55 is P3loss. The pressure loss P3loss can be represented by P3loss (D)(=R1·Qout(D)) as a function of a duty value D, since the ink circulation flow rate Qout of the ink circulation pipe 55 is changed according to the duty value D and the ink circulation flow rate Qout is represented as a function Qout(D) of the duty value D.

An ink pressure Ph of the ink meniscus in the nozzles of the printing head 43 can be represented by Ph=P(H)+Pdec−P1loss−P2loss+P3loss(D). Regarding the pressure, Pdec, which is represented by a positive pressure (>0) and a negative pressure (<0) where 1 atmospheric pressure is "0", is a negative pressure, whereby Pdec<0.

In the example, in order to maintain the ink pressure Ph at a target value suitable for ink ejection, the third pump 39 (depressurization pump) and the pressure open valve 40 are controlled such that the air chamber 25*a* is a target negative pressure value Pdectrg corresponding to the pressure loss P3loss(D)(=Qout(D)·R3) changed according to the ink circulation flow rate Qout(D). The target negative pressure value Pdectrg is represented by Pdectrg=Po−Ph(H)−P3loss(D). Po is a constant number represented by Po=Phtrg+P1loss+P2loss when a target value of Ph is Phtrg.

The ink ejection flow rate Qh of the printing head 43 is changed according to the printing mode even when the duty value D is the same. Accordingly, when the target negative pressure value Pdectrg is acquired, the printing mode is also considered. As the printing modes, there are a high speed printing mode placing priority on printing speed over printing quality, and a low speed printing mode (high quality printing mode) placing priority on printing quality over printing speed. In the high speed printing mode, the printing speed is higher than that of the low speed printing mode in the printing of the same image, and thus the ink ejection flow rate Qh (cc/min) is high. For this reason, the function P3loss(D) is separately prepared for the high speed printing mode and the low speed printing mode in the ROM 68. The target negative pressure value Pdectrg is calculated using the formula applying the function P3loss(D) corresponding to the printing mode read from the ROM 68 at that time.

As described above, in the embodiment, the computer 61 in the control device 60 calculates the target negative pressure value Pdectrg, using the formula Pdectrg=Po−Ph(H)−P3loss(D), on the basis of the duty value D for the printing head control and the liquid head difference H determined from the liquid surface height Hsub of the liquid surface A2 of the ink in the sub-tank 25 at that time and the printing mode at that time. The computer 61 controls the third driving motor 38 for the third pump 39 (depressurization pump) and the pressure open valve 40 such that the real negative pressure value Pdet detected by the pressure sensor 58 coincides with the target negative pressure value Pdectrg.

When the liquid surface height is Hsub and a distance from the bottom of the sub-tank 25 to the nozzle opening height (≈ink meniscus surface height Anozl) is h, the liquid head difference H is calculated by H=Hsub+h. The liquid surface height Hsub is acquired using a liquid surface displacement ΔA of the sub-tank 25 after taking the existing liquid surface height Hsubo, when the sub-residual sensor 31 detects the liquid surface, as a reference, by the formula Hsub=Hsubo+ΔA. The liquid surface displacement ΔA is acquired by dividing the ink supplement amount from the first pump 29 to the sub-tank 25 and the ink variation in the sub-tank 25 acquired from the measurement result or the calculation result of the amount of ejected ink consumed by the printing head 43 by a cross section parallel to the liquid surface of the sub-tank 25 after the detection of the sub-residual sensor 31. Of course, a liquid amount sensor for detecting the liquid amount of the sub-tank 25 may be provided to acquire the liquid surface height Hsub on the basis of the detection value of the liquid amount sensor.

For example, when the printing amount is small and the duty value D is relatively small, the ink circulation flow rate Qout is increased. When the printing amount is large and the duty value D is relatively large, the ink circulation flow rate Qout is decreased. When the ink circulation flow rate Qout is high, the pressure loss P3loss determined from the product of the flow path resistance R3 and the ink circulation flow rate Qout is large, the increase of the ink pressure in the ink meniscus is relatively large, and thus the target negative pressure value Pdectrg is high on the depressurization side. When the ink circulation flow rate Qout is low, the pressure loss P3loss determined from the product of the flow path resistance R3 and the ink circulation flow rate Qout is small, the increase of the ink pressure in the ink meniscus is relatively small, and thus the target negative pressure value Pdectrg is low on the depressurization side.

Next, a heating system of heating the ink in the course of supplying the ink from the sub-tank 25 of the printer 11 to the printing head 43, and maintaining the heat of the heated ink supplied to the printing head 43 in the printing head 43 will be described.

As shown in FIG. 1, the heating system is provided with a first heating device 71 (first heating means) that preliminarily heats the ink in the sub-tank 25 supplied from the main tank 15 through the second ink supply pipe 27 to a target temperature and a second heating device 72 (second heating means) that heats the ink heated by the sub-tank 25 and supplied to the third ink supply pipe 47 in a state where there is a slight temperature difference at the part of the connection pipe 48 to the target temperature while removing the temperature difference. The heating system is provided with a heat keeping device 73 (third heating means) installed at each printing head 43 to keep the heated ink in the printing heads 43 supplied through the third ink supply pipe 47 at the target temperature.

The first heating device 71 is provided with a sub-tank heater 33 (tank heater) disposed in the sub-tank 25, and a first temperature sensor 32 detecting a temperature of the ink in the sub-tank 25. The control device 60 controls heat generation of the sub-tank heater 33 such that the detected temperature (temperature of the ink at the position of the first temperature sensor 32) of the first temperature sensor 32 is a first target temperature (target value) that is the target temperature of the ink in the sub-tank 25.

The second heating device 72 is provided with a supply path heater 54 heating the heated ink supplied from the sub-tank 25 at the part of the connection pipe 48 of the third ink supply pipe 47, a thermal conductor 74 (heating block) heating the connection pipe 48 by conducting the heat of the supply path heater 54, and a third temperature sensor 53 detecting the temperature of the thermal conductor 74. The control device 60 controls heat generation of the supply path heater 54 such that the detected temperature (surface temperature of the thermal conductor 74) of the third temperature sensor 53 is a second target temperature (target value).

The heat keeping device 73 is provided with a head heater 45 maintaining the heat of the heated ink in the printing head 43, and a second temperature sensor 44 detecting the temperature of the head heater 45. The control device 60 controls heat generation of the head heater 45 such that the detected temperature (surface temperature of the head heater 45) of the second temperature sensor 44 is a third target temperature (target value) to maintain the heat of the ink in the printing head 43.

Figure 4:
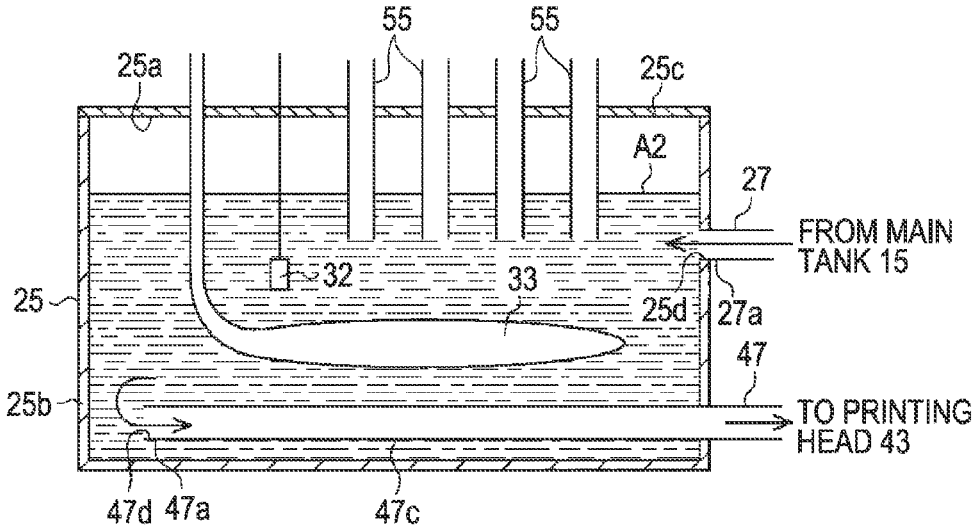
FIG. 4 is a schematic side cross-sectional view illustrating a first heating device.
Figure 5:
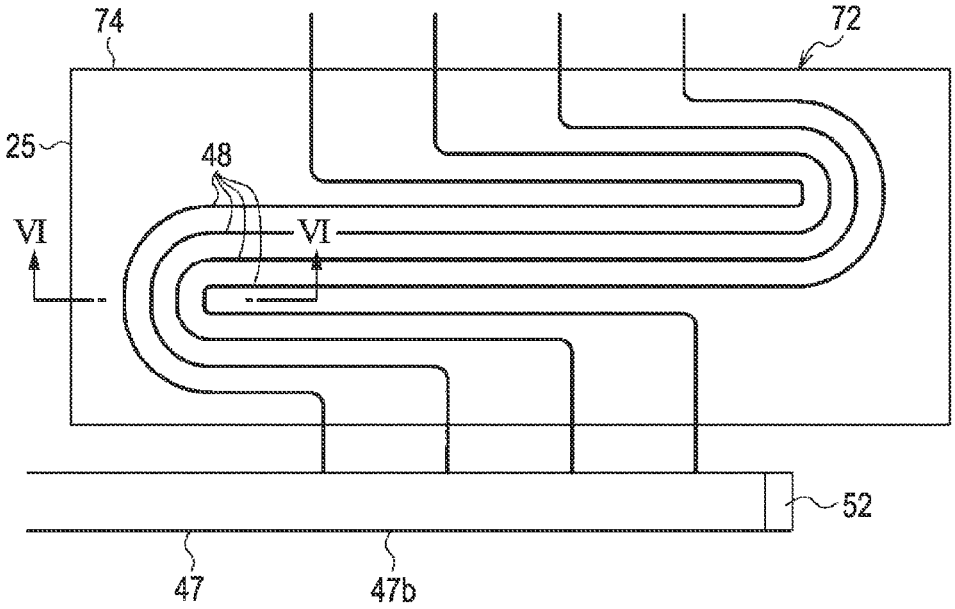
FIG. 5 is a schematic plan cross-sectional view illustrating a second heating device from which a part of the components thereof is removed.
Figure 6:
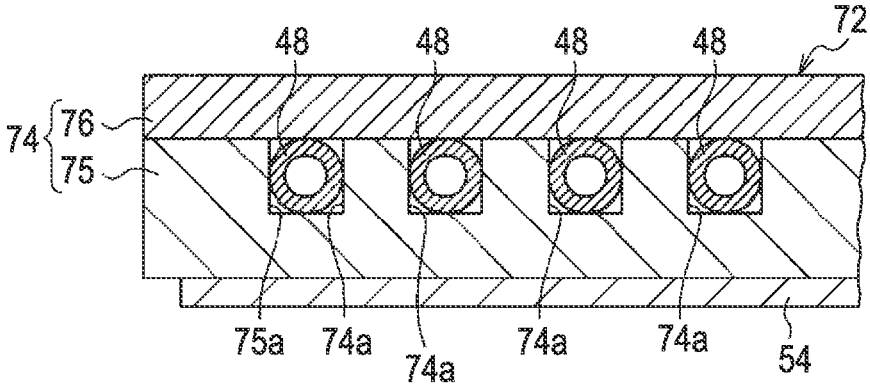
FIG. 6 is a cross-sectional view illustrating the second heating device taken along the line V-V shown in FIG. 5.
Figure 7:
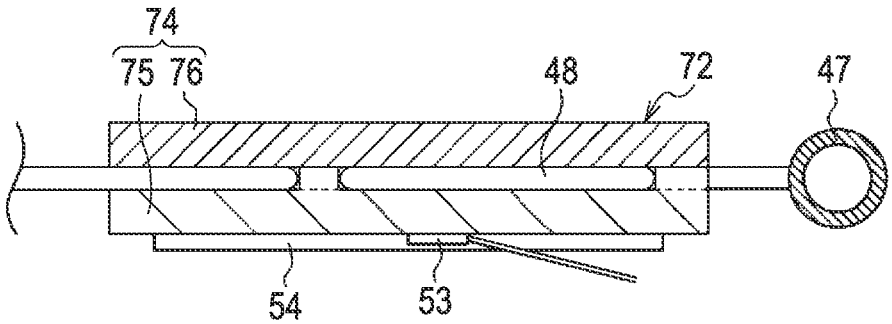
FIG. 7 is a schematic cross-sectional view illustrating the second heating device taken in a direction different from that of FIG. 6.
Figure 8:
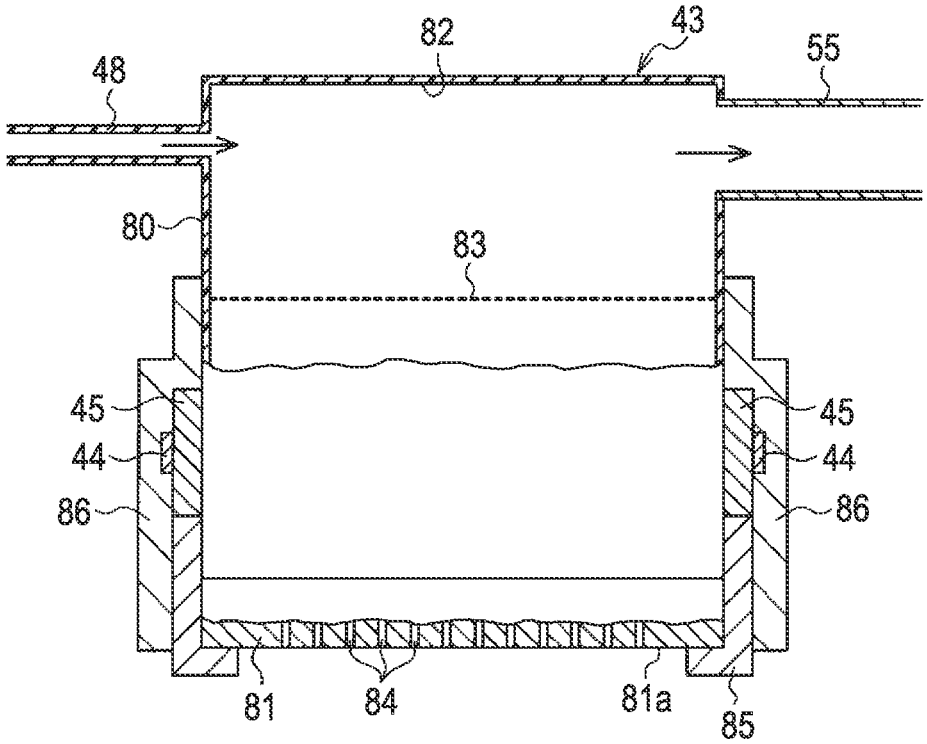
FIG. 8 is a schematic cross-sectional view in which a part of a printing head provided with a heat keeping device is broken.

Next, configurations of the first heating device 71, the second heating device 72, and the heat keeping device 73 will be described in detail. FIG. 4 is a cross-sectional view illustrating the sub-tank 25 provided with the first heating device 71. FIG. 5 is a schematic cross-sectional view illustrating the second heating device 72. FIG. 6 is a schematic partial cross-sectional view illustrating the second heating device 72 taken along the line V-V shown in FIG. 5, and FIG. 7 is a schematic cross-sectional view illustrating the second heating device 72 taken in a direction perpendicular to FIG. 6. FIG. 8 is a schematic cross-sectional view in which a part of the printing head 43 is broken.

First, a configuration and a function of the first heating device 71 will be described. As shown in FIG. 4, the sub-tank 25 is provided with a bottomed cylindrical tank body 25*b*, and a cover portion 25*c* covering the opening of the tank body 25*b*. The sub-tank 25 is formed of a material with relatively low thermal conductivity, high heat resistance, and corrosion resistance by which the ink does not easily infiltrate the sub-tank. As an example of the material, it may be glass or the like. For example, when a heater is provided on the outer wall face of a metal container made of stainless steel or the like, heat is transmitted and heated from an inner circumferential face of the container toward the inside of the ink. Accordingly, it takes a long time until the ink is heated to the first target temperature (e.g., 40° C.). On the other hand, in the embodiment, the sub-tank heater 33 is immersed in the ink in the sub-tank 25. Accordingly, the necessary time until the heating is performed from a peripheral part of the sub-tank heater 33 located slightly under the substantially center of the ink and the average temperature of the whole ink reaches the target temperature is relatively short. In this case, since the sub-tank 25 is formed of an organic material (e.g., glass) with relatively low thermal conductivity as compared with metal, it is hard to radiate the heat of the heated ink from the wall portion of the sub-tank 25 to the outside. From this viewpoint, the necessary time until the temperature reaches the first target temperature is short.

The ink is intermittently supplied to the sub-tank 25. Normal temperature ink flows into the ink heated to the first target temperature. In the embodiment, as shown in FIG. 4, the first temperature sensor 32 is disposed at a position away from the ink inlet 25*d* (liquid inlet portion) from the main tank 15 by a predetermined distance in the ink in the sub-tank 25. The disposition condition of the first temperature sensor 32 is that the first temperature sensor 32 is provided at a position on the side opposite to the ink inlet 25*d* with respect to an imaginary plane passing through the center of the sub-tank heater 33 orthogonal to an imaginary line connecting the ink inlet 25*d* to the center of the sub-tank heater 33. If the temperature sensor 32 is provided in the vicinity of the ink inlet 25*d*, the temperature of the ink immediately cooled at the time point the start of the flow-in of the ink is detected by the sub-tank heater 33, and the sub-tank heater 33 is rapidly heated. At this time, the ink flow has an effect of stirring the ink in the sub-tank 25 while the ink flows in, and thus the temperature of the ink rises while the ink is stirred. Accordingly, the temperature of the whole ink easily rises. However, after the flow-in of the ink is completed, since the stirring effect caused by the ink flow disappears, the temperature of the ink near the ink inlet partially rises. When the partial temperature reaches the target heating temperature, the heating of the sub-tank heater 33 is stopped at that time point although the temperature of the ink at the other part is low. Accordingly, the temperature can be distributed to the ink in the sub-tank 25. The center of the sub-tank heater 33 at the time of determining the disposition condition of the first temperature sensor 32 is a center of a ring shape when the heater is a ring-shaped heater as shown in the embodiment.

On the other hand, in the embodiment, as shown in FIG. 4, the position where the sub-tank heater 33 is disposed in the sub-tank 25 is away from the ink inlet 25*d* by a predetermined distance. Accordingly, it is easy to avoid occurrence of the temperature distribution in which the temperature of the ink is somewhat lower than the target temperature at the part on the opposite side farthest away from the ink inlet 25*d* although the temperature near the ink inlet 25*d* as described above is the target temperature in places.

Specifically, when the normal temperature ink flowing from the inlet (upstream end 27*a*) into the sub-tank 25 flows in from the ink inlet 25*d* by a predetermined distance, the first temperature sensor 32 detects the temperature of the normal temperature ink and the sub-tank heater 33 emits heat. The flowing-in ink that tends to flow mainly on the upside of the sub-tank heater 33 emitting the heat easily flows on the downside due to the difference of specific gravity based on the temperature difference or confluence with the ink flow reflowing from the ink circulation pipe 55. The ink flowing while slightly descending from the ink inlet 25*d* as described above is heated while the ink passes through the vicinity of the sub-tank heater 33. During the ink inflow from the main tank 15, the ink is heated while the ink is stirred by the ink flow. Accordingly, the temperature distribution of the ink in the sub-tank 25 does not occur easily. During the ink circulation, the ink is heated while the ink is stirred by the ink flow from the ink circulation pipe 55. Accordingly, the temperature distribution of the ink in the sub-tank 25 does not occur easily.

When the ink in the vicinity of the sub-tank heater 33 partially becomes the high temperature, the heat may have a bad influence on the ink. For this reason, the first temperature sensor 32 is disposed at a position where such a bad influence based on the heat does not occur. During the ink heating, the temperature distribution occurs in which the ink temperature is higher as it nears the sub-tank heater 33 and the ink temperature is lower as it moves away from the sub-tank heater 33. For example, when the first temperature sensor 32 is separated too far away from the sub-tank heater 33, the peripheral temperature of the sub-tank heater 33 becomes quite high, the ink temperature at the position of the first temperature sensor 32 reaches the target heating temperature, and the heat emitting of the sub-tank heater 33 is first stopped at that time point. In this case, the ink temperature in the vicinity of the sub-tank heater 33 becomes quite high, and the heat may have a bad influence on the ink. When the first temperature sensor 32 is too close to the sub-tank heater 33, the heat emitting by the sub-tank heater 33 is stopped although the peripheral ink temperature moving away from the sub-tank heater 33 is still lower than the target heating temperature when the ink temperature in the vicinity of the sub-tank heater 33 reaches the target heating temperature. For this reason, the first temperature sensor 32 is disposed far away from the sub-tank heater 33 at a proper distance so as to avoid the occurrence of such extreme temperature distribution. The position is set within the range of half of the depth from the liquid surface A2 to the sub-tank heater 33 in a depthwise direction in a state where an intermediate position between the sub-tank heater 33 and the liquid surface (e.g., liquid surface A2 in FIG. 4) is interposed in the middle at the time of stopping the ink inflow from the main tank 15. Particularly, in the example, the first temperature sensor 32 is disposed at a position slightly closer to the sub-tank heater 33 than the intermediate position between the liquid surface A2 and the sub-tank heater 33, within the depthwise range.

A pipe portion 47*c* (pipeline) with a predetermined length constituting a part of the upstream end side of the third ink supply pipe 47 is inserted into the sub-tank 25 to extend at a position slightly above the bottom of the sub-tank 25 along the bottom. An inlet 47*d* of the pipe portion 47*c* is open at a position opposite to the side where the ink flowing in from the ink inlet 25*d* crosses through the inside of the sub-tank 25 with respect to the ink inlet 25*d*. The condition of the insertion position of the pipe portion 47*c* is that the pipe portion 47*c* is inserted by a predetermined length crossing halfway or more through the inside of the sub-tank 25 until the inlet 47*d* reaches the position opposite to the ink inlet 25*d*, with respect to an imaginary plane passing through the center of the sub-tank heater 33 orthogonal to an imaginary line connecting the ink inlet 25*d* to the center of the sub-tank heater 33. Accordingly, the ink heated by the sub-tank heater 33 in the course of flowing from the main tank 15 into the sub-tank 25 and crossing through the inside of the sub-tank 25, or the ink flowing in the vicinity of the inlet 47*d* while being stirred and heated to the average temperature flows in from the inlet 47*d* of the pipe portion 47*c* as shown by the arrow in FIG. 4. For this reason, the normal temperature ink immediately after flowing into the sub-tank 25 avoids flowing from the inlet 47*d* of the pipe portion 47*c* into the third ink supply pipe 47.

Since the pipe portion 47*c* extends along the bottom of the sub-tank 25, the ink is heated even when it passes through the downside of the sub-tank heater 33 while it flows in the pipe portion 47*c*. The sub-tank heater 33 is disposed at a position at a proper distance on the upside from the pipe portion 47*c* to appropriately heat the ink passing through the pipe portion 47*c*. Even if the ink of short heating flows in from the inlet 47*d* of the pipe portion 47*c* at the time when the ink intermittently flows in from the main tank 15, the ink is heated in the course of flowing in the pipe portion 47*c* and passing through the downside of the sub-tank heater 33. Accordingly, the ink heated substantially to the first target temperature flows out from the sub-tank 25 to the third ink supply pipe 47. When the ink does not flow in from the main tank 15, the heat emission by sub-tank heater 33 is suppressed to the extent that the heat of the ink heated to the first target temperature is maintained. Accordingly, even when the ink flowing in the pipe portion 47*c* extending along the bottom of the sub-tank 25 passes through the downside of the sub-tank heater 33, the sub-tank heater 33 does not emit much heat. Therefore, the excessively heated ink does not flow out from the sub-tank 25 to the third ink supply pipe 47. The pipe portion 47*c* extending in the vicinity of the bottom of the sub-tank 25 is located away from the opposite side with respect to the ink inlet 25*d* through which the normal temperature ink flows at a depthwise position slightly under the liquid surface A2, with the position of the sub-tank heater 33 interposed therebetween in the depthwise direction. For this reason, it is easy to avoid the ink passing through the pipe portion 47*c* being cooled by the normal temperature ink immediately after the ink flows in from the ink inlet 25*d*.

The ink supplied from the sub-tank 25 to the printing head 43 through the third ink supply pipe 47 flows back from the printing head 43 to the sub-tank 25 through the third ink supply pipe 47, and thus the heated ink flows in from the ink circulation pipe 55. When the normal temperature ink flows in from the ink inlet 25*d* in the sub-tank 25, the normal temperature ink and the heated ink flowing in from the ink circulation pipe 55 are mixed with each other, thereby preventing the temperature of the ink in the sub-tank 25 from being rapidly decreased. Even when the temperature distribution occurs in the ink in the sub-tank 25 or the temperature is not sufficiently stabilized yet in the course of the heating after the normal temperature ink flows in, an average of the temperature of the ink in the sub-tank 25 is taken and the temperature gradually converges into the target temperature of the ink temperature, due to the inflow of the heated ink flowing in from the ink circulation pipe 55 and slightly cooled from the target temperature and the stirring operation based on the ink flow generated at the time of the inflow. Accordingly, it is possible to suppress the difference in ink temperature of the ink heated to a substantially proper temperature in the sub-tank 25. Therefore, the ink in which the temperature difference is further reduced to be small and the temperature is stabilized can be supplied to the third ink supply pipe 47.

For example, when the ink circulation is not performed during the printing and only the necessary amount of ink is supplied to the printing head 43, the ink at the part where the second heating device 72 is not provided is easily cooled in the third ink supply pipe 47. Accordingly, temperature distribution in which the temperature is non-uniform by positional difference in a lengthwise direction of the third ink supply pipe 47 is generated. Once the temperature distribution is caused by the third ink supply pipe 47, it is hard to resolve the temperature distribution. Accordingly, it has an influence on the ink ejection performance of the printing head 43. On the other hand, in the embodiment, since the ink circulation is performed during the printing (during the liquid ejecting operation) from the printing preparing period and further at the waiting period after the completion of the printing, temperature distribution based on the positional difference in the lengthwise direction does not occur in the ink in the third ink supply pipe 47.

From the above configuration, the sub-tank heater 33 is disposed substantially at the horizontal center of the cylindrical sub-tank 25, in a state where the sub-tank heater 33 is located slightly away from and above the pipe portion 47*c* extending in the vicinity of the bottom in the sub-tank 25 and is located slightly closer to the bottom side than a depthwise position of a half of the depth from the liquid surface A2 to the bottom at the time of stopping the inflow of the ink from the main tank 15. The first temperature sensor 32 is located closer to the end portion opposite to the end portion on the ink inlet 25*d* side than the center of the ring shape of the sub-tank heater 33 (near the left end portion in FIG. 4), and is located within the range where the intermediate position of a half of the depth from the liquid surface A2 to the sub-tank heater 33 is interposed therebetween. Particularly, the first temperature sensor 32 is located closer to the sub-tank heater 33 than the intermediate position of the range.

The ink in the sub-tank 25 is heated to be the first target temperature by the sub-tank heater 33, but it is difficult to remove the temperature distribution of the ink in the sub-tank 25, and it is in the state where the temperature distribution easily occurs when the normal temperature ink intermittently flows in from the main tank 15. For this reason, the ink flowing out from the sub-tank 25 to the third ink supply pipe 47 through the pipe portion 47*c* is heated substantially to the first target temperature, but has a slight temperature difference.

Next, a structure of the second heating device 72 will be described with reference to FIG. 1 and FIG. 5 to FIG. 7. As shown in FIG. 1 and FIG. 5 to FIG. 7, the second heating device 72 is provided with a thermal conductor 74 having connection pipes 48 laid therein, a supply path heater 54 installed in the thermal conductor 74, and a third temperature sensor 53 installed in the thermal conductor 74 to detect a temperature of the thermal conductor 74. The thermal conductor 74 conducts the heat of the supply path heater 54 to heat the connection pipes 48.

As shown in FIG. 6 and FIG. 7, the thermal conductor 74 is provided with a rectangular plate-shaped thermal conductive block 75, and a thermal conductive plate 76 in the same rectangular shape and substantially the same size. A plurality of guiding grooves 75*a* are formed on a face of the thermal conductive block 75 opposed to the thermal conductive plate 76 and the plurality (N) of connection pipes 48 are interposed between the thermal conductive block 75 and the thermal conductive plate 76 in a state where they are accommodated in the guiding grooves 75*a*. As shown in FIG. 6 and FIG. 7, the supply path heater 54 is attached to the surface of the thermal conductor 74 on the thermal conductive block 75 side. The third temperature sensor 53 is attached to the surface of the thermal conductor 74 on the thermal conductive block 75 side and at a position slightly far away from the supply path heater 54. Of course, the third temperature sensor 53 may be attached to the surface of the thermal conductive plate 76 on the side opposite to the position, where the supply path heater 54 is disposed, in the thermal conductor 74.

In the embodiment, the thermal conductive block 75 and the thermal conductive plate 76 constituting the thermal conductor 74 are formed of aluminum metal with high thermal conductivity (e.g., aluminum or aluminum alloy), and the connection pipes 48 are formed of steel metal (e.g., stainless steel) with high ink corrosion resistance. The thermal conductor 74 and the connection pipes 48 accommodated in the guiding paths 74*a* are bonded by brazing. Of course, when the material of the thermal conductor 74 has low thermal conductivity and ink corrosion resistance, the guiding paths 74*a* of the thermal conductor 74 are made into, for example, cross-sectional circular flow paths, and the flow paths may be used as the connection pipes.

As shown in FIG. 5, the N (e.g., 4) connection pipes 48 are substantially parallel and arranged substantially at the same interval from the adjacent pipes, and are disposed along a predetermined meandering path. The N connection pipes 48 with a small diameter are arranged to be long and thin along the meandering path. Since the connection pipes 48 are arranged to be long and thin along the meandering path, it is possible to secure the wide contact area between the connection pipes 48 and the thermal conductor 74 and to secure the wide contact area between the connection pipes 48 provided in the thermal conductor 74 and the ink flowing in the pipes. For this reason, the heat of the supply path heater 54 can be efficiently transmitted to the ink flowing in the connection pipes 48 through the thermal conductor 74.

As shown in FIG. 5, since the connection pipes 48 are substantially parallel and arranged substantially at the same interval from the adjacent pipes along a predetermined meandering path, and thus have a piping structure in which temperature difference does not easily occur among the connection pipes 48. For example, when the N connection pipes are arranged along the meandering path in individual N piping areas, the temperature in the piping area of the connection pipe 48 connected to the printing head 43 with a high ink ejection flow rate becomes relatively low compared to that of the other area, and the temperature in the piping area of the connection pipe 48 connected to the printing head 43 with a low ink ejection flow rate becomes relatively high compared to that of the other area. In this case, there is a problem that differences in the ink temperatures in the connection pipes 48 occur among the connection pipes 48, and further the ink temperatures in the printing heads 43 are dispersed among the printing heads 43.

On the other hand, as described in the embodiment, when the N connection pipes 48 are substantially parallel and arranged substantially at the same interval from the adjacent pipes along a predetermined meandering path in the same area of the thermal conductor 74 and even if the peripheral temperature of the connection pipe 48 corresponding to the printing head 43 with a high ink ejection flow rate is decreased, the other connection pipe 48 also passes through the area in which the temperature thereof is decreased. For this reason, the ink temperature in the connection pipes 48 is not easily dispersed among the connection pipes 48.

Since the connection pipes 48 extend to be long and thin, the flow path resistance R2 thereof is high. Even if pulsation of the fourth pump 50 is damped and continuously propagated to the connection pipes 48 through the common pipe 47*b*, the pulsation is damped and disappears due to high dynamic pressure when the ink passes through the connection pipes 48. Accordingly, weak pulsation does not propagate in the printing head 43.

The N connection pipes 48 arranged along the meandering path as shown in FIG. 5 have substantially the same pipeline length. For this reason, the ink pressure which can be made substantially equal at the inlet parts of the connection pipes 48 by the flowing of the ink passing through the thick common pipe 47*b* with small pressure loss undergoes the substantially same pressure loss when the ink passes through the connection pipes 48 with the same flow path length. Accordingly, the ink pressures in the printing head 43 become substantially the same among the printing heads 43.

Next, a structure of the heat keeping device 73 will be described with reference to FIG. 8. As shown in FIG. 8, the printing head 43 is provided with a head body 80, and a head portion 81 fixed to the downside of the head body 80. An ink chamber 82 is formed in the head body 80, and the connection pipe 48 and the ink circulation pipe 55 are connected at positions opposed to the upper part of the head body 80 with the ink chamber 82 interposed therebetween. The ink chamber 82 is provided with a filter 83 in the course of reaching the head portion 81 from the upside communicating with the connection pipe 48, and bubbles and foreign substances in the ink flowing in the head portion 81 of the ink flowing from the connection pipe 48 into the ink chamber 82 are removed by the filter 83.

The ink passing through the filter 83 in the ink chamber 82 flows into the head portion 81, and is ejected as ink droplets from the plurality of nozzles 84 opened to a nozzle forming face 81*a* that is a lower face of the head portion 81. The head portion 81 is provided with pressure chambers (not shown) communicating with the nozzles 84 in the same number as that of the number of nozzles, each pressure generating element installed for each nozzle 84 vibrates one wall portion (vibration plate) of the pressure chamber to apply ejection pressure to the ink therein, thereby ejecting ink droplets from the nozzles 84. As an example of the pressure generating element, there is a piezoelectric element, an electrostatic element, a heater used for thermal type ink jet, and the like.

As shown in FIG. 8, the heat keeping device 73 for keeping the heat of the heated ink flowing into the ink chamber 82 is installed on the outer wall face of the printing head 43. A head cover 85 (heating member) made of metal is attached to the printing head 43 over the head side portion from the peripheral portion of the nozzle forming face 81*a* of the head portion 81. The head heater 45 is installed to come into contact with the head cover 85. The second temperature sensor 44 installed in the head heater 45 directly detects a surface temperature of the head heater 45.

For this reason, it is possible to reduce a control range at the time of controlling the head heater 45 to emit heat such that the detected temperature of the second temperature sensor 44 approaches the third target temperature (target temperature for keeping heat) of the second temperature sensor 44. For example, in a configuration of directly detecting the ink temperature and the temperature of the head cover 85 and the heating plate 86, when it is detected that the ink is cooled or the ink is heated, the head heater 45 has been already somewhat cooled or somewhat heated. Accordingly, the declination range of the temperature of the head heater 45 becomes relatively wide. On the other hand, in a configuration of directly detecting the surface temperature of the head heater 45, the head heater 45 can be maintained at a substantially constant temperature (third target temperature), the temperature of the printing head 43 can be maintained at the third target temperature, and thus it is possible to secure the heat maintaining effect of the heated ink in the printing head 43. For this reason, it is possible to avoid a situation where the ink is excessively heated or cooled by overshoot occurring when the control range of the temperature is wide. Since the control range of the temperature of the head heater 45 is narrow, the temperature of the ink in the printing head 43 is kept at the third target temperature.

The heating plate 86 is installed on the outer wall portion of the printing head 43 in contact with both of the surface of the head heater 45 and the surface of the head cover 85 to cover the side face. Accordingly, the heat of the head heater 45 can be directly transmitted to the side face of the printing head 43 and can be transmitted to the side face of the printing head 43 through the heating plate 86, and the heat can be transmitted to the side of the head portion 81 and the peripheral portion of the nozzle forming face 81*a* through the heating plate 86 and the head cover 85. In this case, the heat of the head heater 45 can be directly transmitted to the head cover 85 through the end face contact portion, and can be transmitted to the side surface of the head cover 85 through the heating plate 86. For this reason, it is possible to efficiently transmit the heat to the side face of the head portion 81 and the peripheral portion of the nozzle forming face 81*a*. Accordingly, it is possible to efficiently keep the heat of the ink in the nozzles 84 or the pressure chamber of the head portion 81 using the heat keeping device 73. As a result, the ejection performance of ink droplets ejected from the nozzles 84 is satisfactory.

In the embodiment, the head body 80 is formed of base resin, and a part including the nozzle forming face 81*a* of the head portion 81 is formed of a material with higher thermal conductivity than the base resin of the head body 80. In the embodiment, a part including the nozzle forming face 81*a* of the head portion 81 is formed of, for example, silicon. The silicon has thermal conductivity higher than that of resin or ceramics although it is not higher than metal. Accordingly, the heat of the head heater 45 is conducted to the peripheral portion of the nozzle forming face 81*a* and the side wall portion in the head portion 81 through the heating plate 86 and the head cover 85, and it is possible to keep the heat of the ink in the head portion 81 by heating the whole head portion 81 to a uniform temperature substantially equal to the temperature of the head heater 45.

In this case, even when the head body 80 is heated from the outside, it is difficult to transmit the heat to the ink in the ink chamber 82, the downstream flow path, the pressure chamber, and the nozzles 84. However, in the configuration of the embodiment, the head cover 85 to which the heat is transmitted from the head heater 45 through the heating plate 86 heats the side portion of the head portion 81 and the peripheral portion of the nozzle forming face 81*a*. For this reason, in the head body 80 in which it is difficult to heat the ink in the ink chamber 82, the ink tends to be gradually cooled while the ink is sent from the ink chamber 82 to the downstream side in the printing head 43 formed of resin, but the ink in the nozzles 84 positioned at the downstream end of the ink flow path or the pressure chamber is heated by heating the head portion 81. Accordingly, the temperature of the ink in the printing head 43 before ejection is kept at the third target temperature, and thus the satisfactory ejection performance of the printing head 43 is secured.

The first heating device 71, the second heating device 72, and the heat keeping device 73 constituting the heating system as described above realize the function of the first heating, the second heating, and the heat keeping by the disposition and structure of the heater, the temperature sensor, the heating unit (thermal conductor, heating plate), and the like. In addition, the first heating, the second heating, and the heat keeping are realized also by a feedback control of the heaters 33, 45, and 54 performed by the control device 60.

In the embodiment, the computer 61 of the control device 60 performs a PID control of the heaters, 33, 45, and 54 such that the temperature detected by the temperature sensors 32, 44, and 53 approaches the target temperature. In the sub-tank heater 33, the PID control in a wide control range of temperature is performed based on P and a temperature control rapidly following temperature variation is performed. The supply heater 54 based on P, but a control range thereof is narrow. In the supply heater 54, the PID control relatively rapidly following temperature variation is performed although it is not more rapid than that of the sub-tank heater 33. In the head heater 45, the temperature difference between the detected temperature and the target temperature is the same as that of the other controls, but a control range of temperature is narrowest as compared with the other controls. Even when there is temperature variation deviating from the target temperature in the head heater 45, the PID control in which the real temperature smoothly follows the third target temperature is performed.

Next, an ink supply control and a cleaning control executed by the computer 61 of the control device 60 will be described.

The computer 61 executes an ink supply control routine for every predetermined period (e.g., predetermined time within a range of 1 to 100 milli-seconds) which is preset. At the time of power off of the printer 11, the opening and closing valves 30, 37, 41, 51, and 56 are closed. When the power of the printer 11 is turned on, the computer 61 opens the opening and closing valves 30, 41, 51, and 56 and drives the third pump 39 and the fourth pump 50. As a result, the inside of the air chamber 25*a* becomes negative pressure by a discharge operation of the air from the inside of the air chamber 25*a* performed by the third pump 39, and the negative pressure acts on the liquid face A2 of the ink in the sub-tank 25, thereby reducing the ink pressure in the sub-tank 25. In this state, the fourth pump 50 is driven to eject the ink, whereby the ink is supplied from the sub-tank 25 to the printing head 43 through the third ink supply pipe 47. At this time, the ink is supplied through the third ink supply pipe 47 at an ink ejection flow rate Qpump (=ink supply flow rate Qin) of, for example, 20 N (cc/min) by the ejection driving of the fourth pump 50.

Distances (flow path length) of the ink flowing until the ink flows through the common pipe 47*b* of the third ink supply pipe 47 and reaches the inlet positions (branch parts) of the N connection pipes 48 are different from each other. However, the flow path resistance R1 of the common pipe 47*b* is low and there is little pressure loss, and thus the ink supply pressures of the ink at the time of reaching the inlets of the N connection pipes 48 are substantially the same among the connection pipes 48. The ink flow path resistance R2 at the time of flowing through the slender connection pipes 48 with a small diameter and along the meandering path (snaky path) is very high. For this reason, the amounts of ink supplied into the printing heads 43 are substantially the same among the printing heads 43. Some pulsation of the fourth pump 50 which is not damped by the damper 52 propagates to the inlets of the connection pipes 48, but pulsation barely propagating due to the dynamic pressure of the ink at the time of flowing through the connection pipes 48 with the high flow path resistance R2 almost disappears, and the pulsation is prevented from affecting the inside of the printing head 43.

In the printing head 43, the ink is consumed to the extent that the ink is ejected from the nozzles 84. In this case, the ink is consumed as much as the ink ejection flow rate Qh corresponding to the duty value D at that time, in the ink supplied to the printing head 43 at a flow rate of 20 (cc/min). In the embodiment, ink consumption per one printing head is 10 (cc/min) during the printing at the maximum (full) duty. The ink is supplied at a high ink supply flow rate Qin (=20 N (cc/min)) by the fourth pump 50 (supply pump), as compared with the maximum ink ejection flow rate Qhmax (=10 N (cc/min)) when all the N printing heads 43 perform the printing at the maximum (full) duty. Accordingly, during the printing as well as when printing is stopped, the ink flows back from the printing head 43 to the sub-tank 25 through the ink circulation pipe 55 at an ink circulation flow rate Qout (=Qin−Qh) as much as the ink ejection flow rate Qh is subtracted from the ink supply flow rate Qin. For this reason, even during printing at the maximum duty, the ink always flows back through the ink circulation pipe 55. Accordingly, the ink once flowing out from the printing head 43 to the ink circulation pipe 55 does not return from the ink circulation pipe 55 to the printing head 43. Therefore, it is possible to avoid deterioration of ejection characteristics of the printing head 43 given that the cooled UV ink once flowing out to the ink circulation pipe 55 returns back to the inside of the printing head 43 to decrease the ink temperature in the printing head 43.

Figure 9:
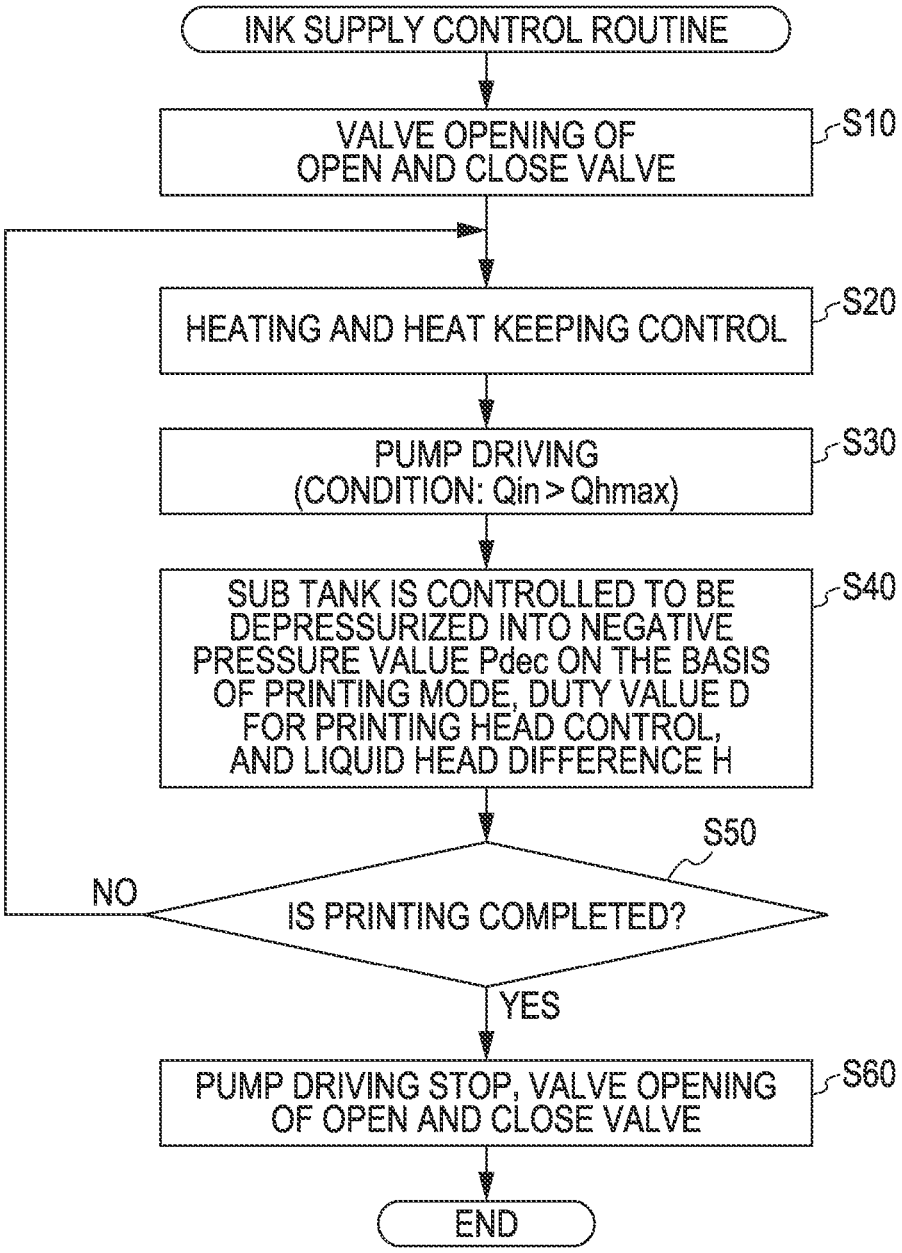
FIG. 9 is a flowchart illustrating an ink supply control routine.
Figure 10:
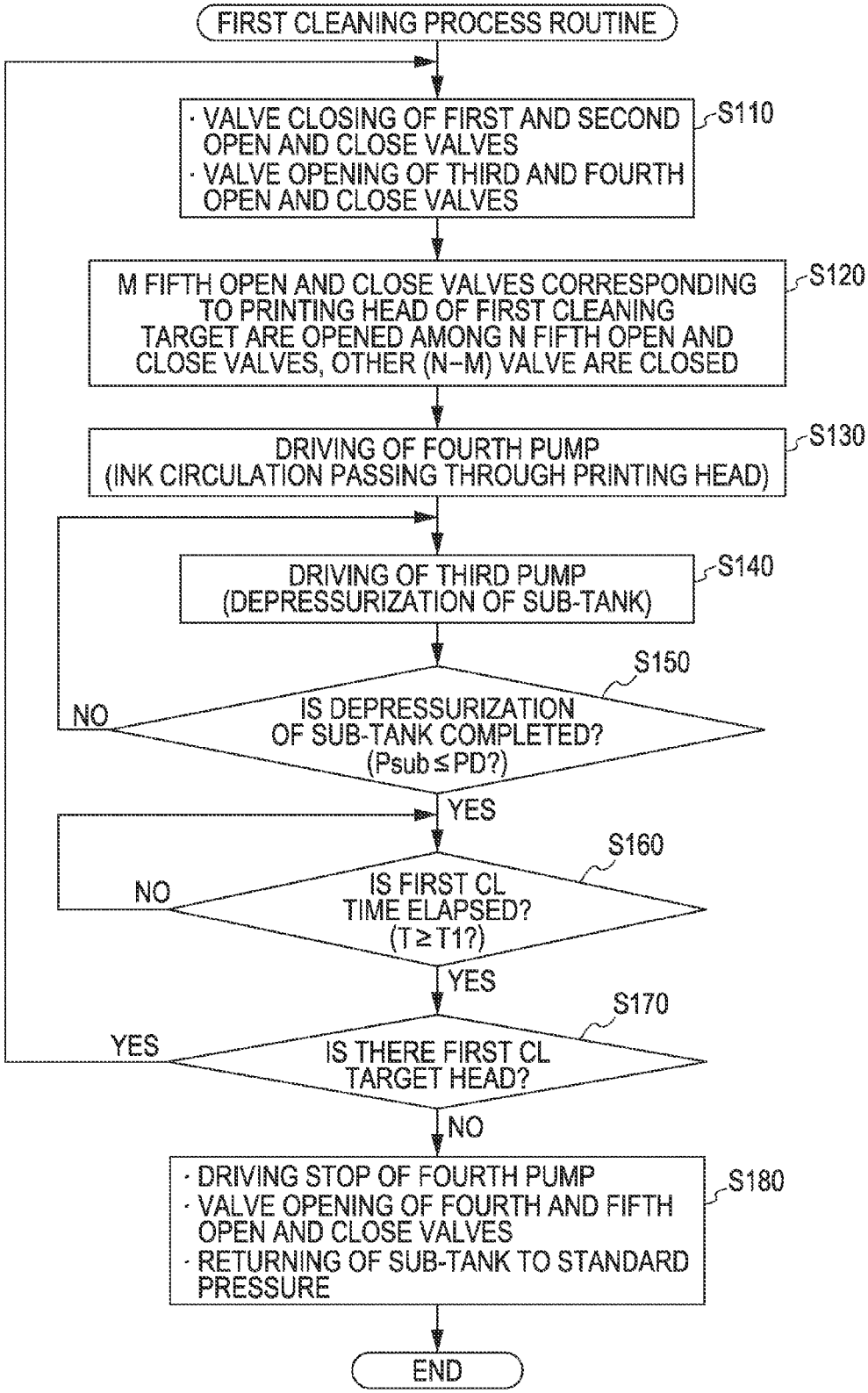
FIG. 10 is a flowchart illustrating a first cleaning process routine.

A program of a printing process routine for the ink supply control at the time of printing, shown by a flowchart in FIG. 9, is stored in the ROM 68. When the printing starts, the computer 61 (specifically, the CPU 67 therein) executes the printing process routine shown in FIG. 9 to perform the ink supply control at the time of printing. Hereinafter, the ink supply control performed by the computer 61 at the time of printing will be described with reference to FIG. 9. During waiting of the printer 11 before starting the printing, the ink is circulated between the sub-tank 25 and the printing head 43. However, when the waiting state is kept for a predetermined time, the circulation of the ink is stopped. Herein, it is considered that the ink circulation is stopped when accepting a printing job. In this case, the opening and closing valves 51 and 56 on the third ink supply pipe 47 and the ink circulation pipe 55, and the opening and closing valves 37 and 41 in the pressurization and depressurization device 34 are closed. The pressurization and depressurization device 34 is driven such that the air chamber 25*a* reaches the target pressure, according to the volume of the air chamber 25*a* with variation of the liquid amount in sub-tank 25.

First, in Step S10, the opening and closing valves are opened to supply the ink to the printing heads 43. That is, the opening and closing valve 51 on the third ink supply pipe 47, the opening and closing valve 56 on the ink circulation pipe 55, and the opening and closing valve 41 of the pressurization and depressurization device 34 are opened.

In Step S20, the heating and heat keeping control of the ink in the ink supply path and the printing head are performed. The computer 61 starts the pressurization and heat keeping control of the ink from the time when the power of the printer 11 is turned on, and this step represents a part of the heating and heat keeping control performed during the printing. That is, the computer 61 controls the temperature of the sub-tank heater 33 on the basis of the detection result of the first temperature sensor 32. The computer 61 controls the temperature of the supply path heater 54 on the basis of the detection result of the third temperature sensor 53. The computer 61 controls the temperature of the head heater 45 on the basis of the detection result of the second temperature sensor 44.

In Step S30, the fourth pump for supplying the ink is driven. At this time, the fourth pump 50 is controlled to satisfy the condition of the ink supply flow rate Qin (Qin>Qhmax) higher than the maximum ink ejection flow rate Qhmax.

In Step S40, the pressure of the air chamber 25*a* of the sub-tank 25 is controlled to be the negative pressure value Pdec based on the printing mode, the duty value D for controlling the printing head, and the liquid head difference H. That is, P3loss(D) corresponding to the printing mode is selected, the target negative pressure value Pdectrg is calculated using the duty value D and the liquid head difference H by the formula Pdectrg=Po−Ph(H)−P3loss(D). The computer 61 controls the third pump 39 (depressurization pump) and the pressure open valve 40 such that the real negative pressure value Pdecreal detected by the pressure sensor 58 coincides with the target negative pressure value Pdectrg. As a result, the air chamber 25*a* is controlled to be the target negative pressure value Pdectrg. Specifically, when the real negative pressure value Pdecreal is smaller in absolute value than the target negative pressure value Pdectrg, the computer 61 drives the third driving motor 38 to drive the third pump 39 to perform depressurization, thereby depressurizing the air chamber 25*a* until the real negative pressure value Pdecreal coincides with the target negative pressure value Pdectrg. When the ink in the sub-tank 25 is decreased to increase the volume of the air chamber 25*a*, the pressure of the air chamber 25*a* is decreased. At this time, the real negative pressure value Pdecreal becomes larger in absolute value than the target negative pressure value Pdectrg. As described above, when the real negative pressure value Pdecreal is larger in absolute value than the target negative pressure value Pdectrg, the computer 61 opens the pressure open valve 40 to open the air chamber 25*a* to the air, and allows the air to flow into the air chamber 25*a* at a low flow rate until the real negative pressure value Pdecreal coincides with the target negative pressure value Pdectrg.

In Step S50, it is determined whether or not the printing is completed. When the printing is not completed (i.e., during the printing), the process returns to Step S20. In Step S50, the processes of Steps S20 to S40 are repeatedly performed until it is determined that the printing is completed. When the printing is completed, in Step S60, the driving of the fourth pump 50 is stopped to stop the supply of the ink, the opening and closing valves 51 and 56 are closed after the driving of the fourth pump 50 is stopped, to cut off the flow paths of the third ink supply pipe 47 and the ink circulation pipe 55.

Next, the cleaning will be described. The printer 11 has a cleaning function to prevent and resolve ejection faults of the printing head 43. In the printer 11 of the embodiment, as described above, the first cleaning to remove bubbles in the ink in the ink chamber 82 of the printing head 43, and the second cleaning to prevent and dissolve nozzle clogging of the printing head 43 are prepared. The first cleaning is performed at the time of replacing the ink cartridge, at the time of initial charging, at the time when bubbles are mixed into the ink due to long term non-use of the printer or at a time when there is a concern that bubbles may be mixed therein.

Figure 11:
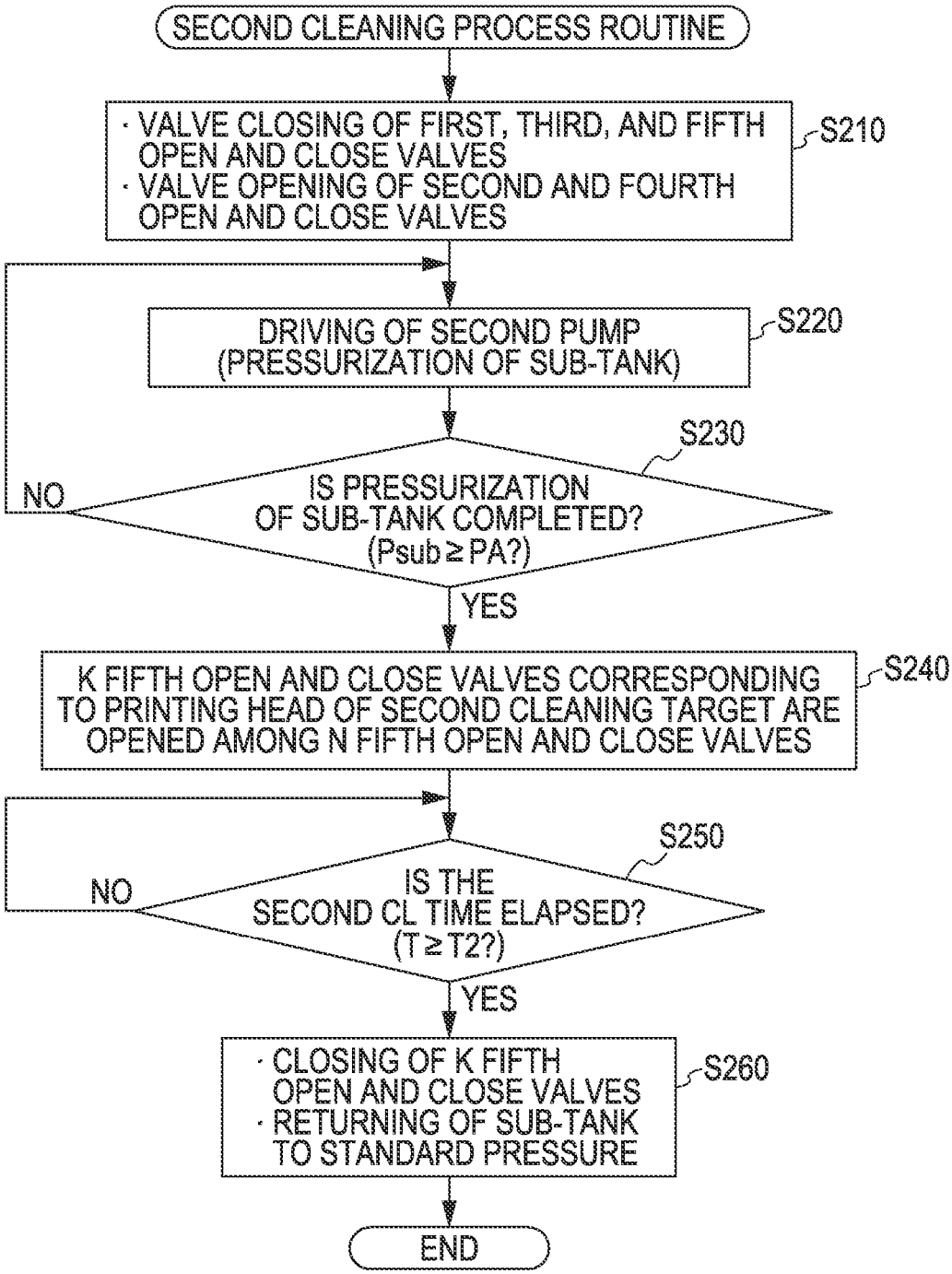
FIG. 11 is a flowchart illustrating a second cleaning process routine.

The printer 11 is provided with a nozzle examining device (not shown) examining whether or not there is the nozzle clogging for each printing head 43. When the cleaning is instructed by operation of a user and when it is determined that the time elapsed from the time point of the completion of the previous cleaning reaches a predetermined time on the basis of a count time of a cleaning timer (not shown), the control device 60 performs the nozzle examination of the printing head 43 with the nozzle examining device. When there is a printing head 43 fault determined to be nozzle clogging from the nozzle examination result of the nozzle examining device, the second cleaning is selectively performed on the faulty printing head 43. In the ROM 68 shown in FIG. 2, a program for a first cleaning process routine shown in FIG. 10 and a program for a second cleaning process routine shown in FIG. 11 are stored.

First, the first cleaning will be described. The computer 61 executes the first cleaning process routine shown in FIG. 10 at the first cleaning executing time in any case corresponding to the time of the ink cartridge replacement, the time of the initial charging, and the time of long-term nonuse of the printer.

First, in Step S110, the first and second opening and closing valves 30 and 37 are closed, and the third and fourth opening and closing valves 41 and 51 are opened. As a result, the communication between the sub-tank 25 and the main tank 15 is cut off by the closing of the first opening and closing valve 30, the sub-tank 25 communicates with the printing heads 43 by the opening of the fourth opening and closing valve 51, the second pump 36 does not communicate with the sub-tank 25 in the pressurization and depressurization device 34, and the third pump 39 communicates with the sub-tank 25.

Next, in Step S120, the M fifth opening and closing valves 56 corresponding to the M printing heads 43 as the targets of the first cleaning among the N (4 in the example) fifth opening and closing valves 56 are opened, and the other (N−M) opening and closing valves 56 are closed. The first cleaning is sequentially performed for each M printing heads 43 by repeated division. In this step, the M printing heads 43 (hereinafter, also referred to as "first cleaning target heads") as the targets of the first cleaning to be performed this time are selected, and the M fifth opening and closing valves 56 corresponding to the selected M printing heads 43 are opened.

Specifically, M in the first cleaning is the maximum number of cleaning targets per cleaning, and the cleaning of the K (M≤K≤N) liquid ejecting heads of the cleaning targets of the N liquid ejecting heads is performed at least |[−K/M]| ([ ] is Gauss's symbol, || is absolute value) times, thereby performing the cleaning of all the K liquid ejecting heads. For example, when the cleaning for K is performed one by one (M=1), the cleaning for each one is performed K (=|[−K]|) times. When the cleaning for 7 is performed two by two (M=2, K=7), the cleaning for each two is performed three times and the cleaning for one is performed once, thereby performing the cleaning total 4 (=|[−7/2]|) times.

In Step S130, the fourth pump 50 (supply pump) is driven. That is, the computer 61 drives the fourth driving motor 49 to drive the fourth pump 50. As a result, the ink circulation is performed such that the ink supplied from the sub-tank 25 to the printing head 43 through the third ink supply pipe 47 flows back again to the sub-tank 25 through the M ink circulation pipes 55.

Next, in Step S140, the third pump 39 (depressurization pump) is driven. That is, the computer 61 drives the third driving motor 38 to drive the third pump 39. The sub-tank 25 is depressurized by driving the third pump 39. That is, the air chamber 25*a* is depressurized by discharging the air from the air chamber 25*a* by the third pump 39, and the negative pressure of the air chamber 25*a* reaches the liquid surface A2 of the ink, thereby depressurizing the ink in the sub-tank 25.

In Step S150, it is determined whether or not the depressurization of the sub-tank 25 is completed. That is, the computer 61 determines whether or not the air pressure (sub-tank pressure) Psub in the sub-tank 25 detected by the pressure sensor 58 reaches (Psub≤PD) the target negative pressure value PD. While Psub≤PD is not satisfied, the third pump 39 continues driving in step S140. When Psub≤PD is satisfied, the process proceeds to Step S160.

In Step S160, it is determined whether or not the first cleaning time elapses. The computer 61 drives the fourth pump 50 to start the ink circulation, and counts the time elapsed from the time point of starting the first cleaning by a timer (not shown). When the counted time T of the timer reaches (T≥T1) a first cleaning time T1 (hereinafter, also referred to as "first CL time T1") that is the time of performing the first cleaning, the computer 61 determines that the first CL time T1 elapses. When the first CL time T1 does not elapse (T≥T1 is not satisfied), the first cleaning continues. When the first CL time T1 elapses (T≥T1 is satisfied), the process proceeds to Step S170.

In Step S170, it is determined whether or not the first cleaning target head (first CL target head) still exists. That is, when the first cleaning for all the N printing heads 43 is not completed and there remains a printing head 43 on which the first cleaning is to be performed, it is determined that there is a first cleaning target head. When the first cleaning target head still exists, the process returns to Step S120 and the processes of Steps S120 to S160 are performed on the first cleaning target head in the same manner, thereby performing the first cleaning. When the first cleaning is performed on all the N printing head 43 and there is no first cleaning target head in Step S170, the process proceeds to Step S180.

In Step S180, the driving of the fourth pump 50 is stopped to stop the circulation of the ink, and the fourth and fifth opening and closing valve 51 and 56 are closed to block the third ink supply pipe 47 and the ink circulation pipes 55. The pressure open valve 40 is controlled such that the air flows from the outside into the sub-tank 25 at a low flow rate to return the sub-tank 25 from the depressurization state to the standard pressure of the printing waiting time. The depressurization of the sub-tank 25 in Steps S140 and S150 is set to a variable target negative pressure value PD corresponding to the ink supply flow rate Qin of one printing head such that ink leakage of the nozzles does not occur or extremely slight ink leakage occurs even when the ink supply flow rate Qin (=ink circulation flow rate Qout) of one printing head becomes N/M times of the value (20 (cc/min) in the example) of the printing time.

In the course of performing the first cleaning, the sending flow rate of the fourth pump 50 is 20 N (cc/min) equal to that of the printing time. The sending flow rate is substantially the upper limit of the capability of the fourth pump 50, and in the example, the flow rate cannot be higher than that. In the example, the number M of the first cleaning target heads is "1", and the first cleaning of the printing heads 43 is sequentially performed one by one. The M (e.g., 1) ink circulation pipe 55 corresponding to the first cleaning target head is opened among the five ink circulation pipes 55, and the other (N−M) (e.g., 3) ink circulation pipes 55 are cut off. For this reason, in the embodiment of M=1, the three ink circulation pipes 55 are cut off, whereby the ink flows back at a flow rate of 20 N (cc/min) through the one ink circulation pipe 55 corresponding to the printing head 43 that is the cleaning target.

All the ink sent at the flow rate of 20 N (cc/min) from the sub-tank 25 to the common pipe 47*b* by the fourth pump 50 circulates on the path passing through the one printing head 43 that is the first cleaning target. All the ink of the flow rate of 20 N (cc/min) for the N printing heads flows into the one printing head 43 at the printing time, and the flow velocity of the ink flowing in the printing head 43 becomes high.

In the example, as shown in FIG. 8, the amount of ink flowing from the connection pipe 48 into the ink chamber 82 of the printing head 43 is N/M times (e.g., 4 times) of that of the printing time, and the ink flowing in the ink chamber 82 until the ink flows in from the connection pipe 48 and flows out from the ink circulation pipe 55 flows at a flow velocity higher than the flow velocity of the printing time by N/M times. Accordingly, bubbles collected in the upside corner of the ink chamber 82 or bubbles caught by the filter 83 are pushed by the high flow velocity and removed from the ink chamber 82.

The ink flow rate of one printing head 43 becomes N/M times, the ink pressure of the printing head 43 rises, and thus ink leakage from the nozzles may occur. However, in the embodiment, the sub-tank 25 is depressurized by the driving of the third pump 39, and thus the ink pressure in the printing head 43 is also depressurized. For this reason, the increase portion of the ink pressure of the ink chamber 82 according to the drastic increase of the ink flow rate of one printing head is substantially offset by the ink depressurization portion of the depressurization of the sub-tank 25. As a result, the ink leakage from the nozzles does not occur. Even if the ink leakage occurs, the amount of leakage can be suppressed.

For example, in a configuration in which the ink flow rate of one printing head is increased and the ink in the printing head is pressurized, bubbles are compressed to be small by the pressurization force and the bubbles do not easily become detached from the filter. On the other hand, in the example, the ink in the ink chamber 82 is depressurized to offset the pressurization of the increased portion of the flow rate, the bubbles in the ink chamber 82 expand as compared with the case of no depressurization, and thus the bubbles caught by the filter 83 are easily detached from the filter 83. In the first cleaning in which the ink flow rate of one printing head is increased as described above, it is possible to improve the effect of removing the bubbles while suppressing the ink leakage from the nozzles, by performing the depressurization of the ink therewith. At the time of performing the first cleaning, capping is performed in advance to bring a cap into contact with the nozzle forming face of the printing head 43. Even if ink is leaked from the nozzles, the leaked ink is received in the cap.

Herein, the target negative pressure value PD of the depressurization control in the first cleaning will be described.

Since the flow path resistance R of the third ink supply pipe 47 is higher than the flow path resistance R3 of the ink circulation pipe 55 (R>R3), the ink pressures Pin at the inlet parts of the connection pipes 48 are substantially the same as the printing time even at the cleaning time, a value that subtracts the flow path resistance R2 of the connection pipe 48 from the ink pressure Pin becomes the ink pressure Phead in the printing head 43.

At this time, the ink pressure Phead in the printing head 43 of the non-cleaning target corresponding to the closed opening and closing valve 56 is increased as the ink gradually flows into the printing head 43 through the connection pipe 48, and the flow of the ink passing through the connection pipe 48 is stopped at the time point when the ink pressure becomes the same as the inlet ink pressure Pin. For this reason, the ink pressure Phead in the printing head 43 is converged into the same value as the inlet ink pressure Pin a short time after the cleaning starts. The inlet ink pressure Pin is represented by Pin=Psub−P1loss=Psub−R1·Qpump, using the sub-tank pressure Psub, the ink ejection flow rate Qpump (=Qintotal) of the fourth pump (supply pump) 50, and the flow path resistance R1.

A meniscus ink pressure Phcl in the nozzles 84 of the printing head 43 of the cleaning target corresponding to the opened opening and closing valve 56 is represented by Phcl=Psub−(N/M)·(P1loss+P2loss−P3loss)+Ph(H) since the ink supply flow rate Qin at the time of flowing into the printing head 43 through the connection pipe 48 is (N/M)·Qintotal/N and the flow path resistance of the connection pipe 48 is R2.

A meniscus ink pressure Phncl in the nozzles 84 of the printing head 43 of the non-cleaning target is represented by Phncl=Psub−P1loss+Ph(H).

From the two formulas, the ink pressure Ph of the first cleaning time can be adjusted by changing the sub-tank pressure Psub when the total number N of printing heads 43, the number M of printing heads 43 of the cleaning targets, and the liquid head difference H are determined. For this reason, in the example, the negative pressure value Pdec of the sub-tank pressure Psub is adjusted such that the ink pressures Phcl and the Phncl are values to the extent that the ink is not leaked from the nozzles 84. When the ink pressure when the ink is not leaked is Phtrg2 and the target negative pressure value of the sub-tank pressure Psub for Ph=Phtrg2 is PDcl and PDncl for the cleaning target and the non-cleaning target, PDcl and PDncl are presented by PDcl=Phtrg2+(N/M)·(P1loss+P2loss−P3loss)−Ph(H) and PDncl=Phtrg2+P1loss−Ph(H). A small value of PDcl and PDncl determined in the two formulas is employed for the target negative pressure value PD. For this reason, in the embodiment, the negative pressure value PD is the sub-tank pressure Psub at the first cleaning time, and thus it is possible to avoid the ink leakage from the nozzles 84.

Next, the second cleaning will be described. The computer 61 controls the nozzle examination device to perform the nozzle examination of the printing heads 43 when the cleaning timer finishes counting the predetermined time from the previous cleaning completed time point, or when the cleaning is instructed by the operation of a user. When it is determined from the nozzle examination result that there is a printing head 43 with nozzle clogging, the second cleaning is performed only on the target printing head 43. When the second cleaning is performed, the computer 61 executes the second cleaning process routine shown in FIG. 11. Hereinafter, it is assumed that there are K printing heads 43 (hereinafter, referred to as second cleaning target head) that are targets of the second cleaning among the N printing heads 43.

First, in Step S210, the first, third, and fifth opening and closing valves 30, 41, 56 are closed, and the second and fourth opening and closing valves 37 and 51 are opened. As a result, the communication between the sub-tank 25 and the main tank 15 is cut off, and all the N ink circulation pipes 55 are cut off. In the pressurization and depressurization device 34, the second pump 36 communicates with the sub-tank 25, and third pump 39 does not communicate with the sub-tank 25.

In Step S220, the second pump 36 (pressurization pump) is driven. That is, the computer 61 drives the second driving motor 35 to drive the second pump 36. The second pump 36 is driven to pressurize the sub-tank 25. That is, the air is transferred from the outside by the second pump 36, the air chamber 25*a* is pressurized, the pressurization force of the air chamber 25*a* reaches the liquid surface A2, and the ink in the sub-tank 25 is pressurized.

In Step S230, it is determined whether or not the pressurization of the sub-tank 25 is completed. That is, the computer 61 determines whether or not the air pressure Psub in the sub-tank 25 detected by the pressure sensor 58 reaches (Psub≥PA) the target pressurization value PA. While Psub≥PA is not satisfied, the second pump 36 continues driving in step S220. When Psub≥PA is satisfied, the process proceeds to Step S240.

In Step S240, K fifth opening and closing valves 56 corresponding to the K printing heads 43 of the second cleaning targets are opened among the N (4 in the embodiment) fifth opening and closing valves 56. As a result, the K fifth opening and closing valves 56 are opened in a state where the pressure of the sub-tank 25 is sufficiently raised, and the pressurized ink is supplied from the sub-tank 25 to the K printing heads 43 through the K ink circulation pipes 55. At this time, since the third ink supply pipe 47 is closed, the pressurized ink is supplied at once to the ink chamber 82 of the printing head 43, and the ink is strongly discharged from the nozzles of the printing head 43.

In Step S250, it is determined whether or not the second cleaning time elapses. The computer 61 opens the K fifth opening and closing valves 56 and counts a time elapsed from the time point of starting the second cleaning by a timer (not shown). When the counted time T of the timer reaches (T≥T2) a second cleaning time T2 (hereinafter, also referred to as "second CL time T2") that is the time of performing the second cleaning, the computer 61 determines that the second CL time T2 elapses. When the second CL time T2 does not elapse (T≥T2 is not satisfied), the second cleaning continues. When the second CL time T2 elapses (T≥T2 is satisfied), the process proceeds to Step S260.

In Step S260, the K fifth opening and closing valves 56 are closed to close the ink circulation pipe 55, the second cleaning is stopped, the opening and closing valves 37 and 41 of the pressurization and depressurization device 34 are newly changed, the third pump 39 is driven to depressurize the sub-tank 25, and thus the sub-tank 25 is returned to the standard pressure at the printing waiting time.

In the second cleaning as described above, the fifth opening and closing valves 56 are opened after waiting for the air pressure Psub in the sub-tank 25 to be raised up to the target pressurization value PA, and thus it is possible to reduce unnecessary ink consumption. For example, when the fifth opening and closing valve 56 is opened for the first time and then the second pump 36 is driven to start pressurization, the ink is leaked from the nozzles of the printing head 43 in the course of the pressurization step until the sub-tank 25 reaches the target pressurization value PA. The leaked ink has no force and does not help to dissolve the nozzle clogging, and it is unnecessary ink consumption. On the other hand, in the second cleaning of the embodiment, the fifth opening and closing valve 56 is opened after the sub-tank 25 is sufficiently pressurized. Accordingly, the ink discharged from the nozzles has force from the beginning and helps to dissolve the nozzle clogging, and thus it is possible to suppress unnecessary ink consumption.

As a method of nozzle cleaning, a method is conceivable in which the fourth pump 50 is driven in a state where all the fifth opening and closing valves 56 are closed, the ink is supplied from the sub-tank 25 to the printing head 43 through the third ink supply pipe 47, and the ink is compulsorily discharged from the nozzles of the printing head 43. However, in this case, the pressure loss is large when the ink passes through the connection pipe 48 with the high flow path resistance. Accordingly, the force of the ink discharged from the nozzles of the printing head 43 cannot be obtained in a large amount, as compared with the case where the sub-tank 25 is pressurized by the second pump 36 and the high ink pressurization force is generated on the upstream side by the ejection force of the fourth pump 50. On the other hand, in the second cleaning of the embodiment, the pressurized ink is supplied to the printing head 43 through the ink circulation pipe 55 with the low flow path resistance, the pressure loss is low when the pressurized ink passes through the ink circulation pipe 55, and it is possible to strongly discharge the ink from the nozzles of the printing head 43.

According to the embodiment, it is possible to obtain the following advantages.

(1) The flow path resistance R (≈R2>R1) of the third ink supply pipe 47 (supply path) and the flow path resistance R3 of the ink circulation pipe 55 (circulation path) are set to satisfy the relation of R<R3. For this reason, the flow rates of ink supplied to the printing heads 43 can be made substantially equal, and it is possible to keep the ink pressure in the printing heads 43 low while suppressing differences of ink pressure among the printing heads 43 to the minimum. Accordingly, the ink pressure of the printing heads 43 falls within a permissible range, and a proper quantity of ink droplets can be ejected while suppressing ink leakage from the printing heads 43 during the printing.

(3) The flow path resistance R1 of the common pipe 47*b* of the third ink supply pipe 47, the flow path resistance R2 of the connection pipe 48, and the flow path resistance R3 of the ink circulation pipe 55 are set to satisfy the relation of R1<R3<R2. Accordingly, the flow rates of the ink supplied to the printing heads 43 can be made substantially equal and the ink pressure in the printing heads 43 can be kept low while suppressing differences of ink pressure among the printing heads 43. At least at the time of printing, a diameter of the ink circulation pipe 55 is made small to the extent that the ink circulation flow rate Qout is less than the ink supply flow rate Qin, and thus it is possible to miniaturize the ink circulation pipe 55.

(4) In the printing head 43, since the fluctuation of the ink pressure is required to fall within ±50 Pa, it is preferable that the flow path resistance R2 of the connection pipe 48 is set to satisfy the relation that it is five times or more than the flow path resistance R3 of the ink circulation pipe 55. Accordingly, by satisfying the relation of R2≥5·R3, the fluctuation of the ink pressure in the printing head 43 falls within ±50 Pa regardless of the printing mode, and it is possible to stabilize the amount of ink ejected from the nozzles of the printing head 43.

(5) The ink is supplied to the printing head 43 at the ink supply flow rate Qin higher than the maximum ink ejection flow rate Qhmax of the printing head 43 during the printing at the maximum duty value Dfull (maximum ejection flow rate) (Qin>Qhmax). Accordingly, even during the printing at the maximum duty value Dfull, it is possible to prevent the cooled ink flowing out one time from the printing head 43 to the ink circulation pipe 55, from flowing backward into the printing head 43. As a result, the ink temperature in the printing head 43 can be stably maintained at a proper value, and the ink in the printing head 43 can be maintained at a low viscosity suitable for ejection. Therefore, it is possible to realize high printing quality by suppressing differences in ejection performance of the ink among the printing heads 43.

(6) The connection pipe 48 is formed to be slender in order to raise the flow path resistance R2 of the connection pipe 48. Accordingly, it is possible to efficiently heat the ink flowing in the third ink supply pipe 47 by providing the connection pipe 48 with the second heating device 72.

(9) In the first cleaning, the fourth pump is driven in the state where at least one opening and closing valve is closed, whereby the ink is circulated along the circulation flow path passing from the sub-tank 25 through the printing head 43 to allow the ink to flow to the printing head 43 of the cleaning target at the high flow rate, the sub-tank 25 is depressurized, and it is thus possible to effectively remove the bubbles in the ink in the printing head 43.

(10) The sub-tank 25 is depressurized by the third pump 39, and thus it is possible to improve the effect of removing the bubbles while suppressing the bubbles in the ink in the printing head 43 from being small and to reduce the amount of ink discharged from the nozzles 84 of the printing head 43.

(11) In the second cleaning, the second pump 36 is driven in the state where the fifth opening and closing valve 56 is closed, and the fifth opening and closing valve 56 is opened after waiting for the ink in the sub-tank 25 to be pressurized (compressed) to a predetermined pressure. Accordingly, it is possible to perform the nozzle cleaning while suppressing the unnecessary ink discharge during the pressurizing. In this case, the fourth opening and closing valve 51 on the third ink supply pipe 47 with the high flow path resistance R is closed and the pressurized ink is sent to the printing head 43 through the ink circulation pipe 55 with the low flow path resistance R3. Accordingly, the pressure loss is small when the pressurized ink is supplied from the sub-tank 25 to the printing head 43, and thus it is possible to perform the strong nozzle cleaning. At the second cleaning time, the heated ink in the third ink supply pipe 47 hardly flows, and thus the heated ink in the third ink supply pipe 47 is not unnecessarily discharged by the nozzle cleaning. For this reason, at the printing time after the cleaning is completed, the heated ink with low viscosity in the third ink supply pipe 47 is used, and it is possible to perform satisfactory printing.

(12) Since the sub-tank heater 33 is immersed in the ink in the sub-tank 25, it is possible to raise the average temperature increasing rate (heating rate) of all the ink in the sub-tank 25.

(13) Since the sub-tank 25 is formed of an organic material with thermal conductivity lower than that of metal, the heat of the ink in the sub-tank 25 is hardly emitted through the wall portion of the sub-tank 25. Accordingly, it contributes to the raising of the heating rate of the ink in the sub-tank 25.

(14) The pipe portion 47*c* constituting a part of the upstream end side of the third ink supply pipe 47 in the sub-tank 25 is inserted to cross the inside of the sub-tank 25 along the bottom, and the inlet 47*d* of the pipe portion 47*c* is positioned on the side opposite to the ink inlet 25*d* from the main tank 15. Accordingly, it is possible to avoid a case where the ink which is not particularly heated immediately after the ink flows in from the ink inlet 25*d* is sent to the third ink supply pipe 47.

(15) Since the first temperature sensor 32 is immersed in the ink in the sub-tank 25, it is possible to raise the response speed until the heating is started after the real temperature of the ink in the sub-tank 25 is decreased. For example, the first temperature sensor 32 rapidly detects the temperature of the normal temperature ink flowing in from the main tank 15, and promptly allows the sub-tank heater 33 to emit heat. Accordingly, even when the normal temperature ink is flowing in, the ink heated to substantially the first target temperature can be supplied to the third ink supply pipe 47.

(16) Since the first temperature sensor 32 is separated from the sub-tank heater 33 by a proper predetermined distance, it is possible to avoid a problem of variation in characteristics caused by excessive heating of the ink caused when it is too close, deterioration in responsiveness caused when it is too far, and decrease of the average temperature increasing rate of the whole ink in the sub-tank 25. Particularly, the first temperature sensor 32 is disposed in the range opposite to the ink inlet 25*d* from the center of the sub-tank heater 33, and is disposed within the range (particularly, a position closer to the sub-tank heater 33 than the center within the range) of half of the depth in the state where the center of half of the depth from the liquid surface A2 at the time of stopping the ink supply from the main tank 15 to the sub-tank heater 33 is interposed at the center. Accordingly, it is possible to raise the response speed of the heating starting time when the normal temperature ink flows into the sub-tank 25, and the average temperature increasing rate (the increasing rate of the average temperature obtained by leveling the ink temperature distribution in the sub-tank 25) of the whole ink after starting the heating.

(17) The connection pipes 48 are interposed by the thermal conductor 74 (heating block), the heat of the supply path heater 54 is conducted, and the connection pipes 48 are heated by the thermal conductor 74 substantially at the same temperature as the temperature of the supply path heater 54. Accordingly, the heated ink in the connection pipe 48 can be heated to remove the temperature difference by the heat transmission from the thermal conductor 74 kept substantially at the target temperature.

(18) The thermal conductor 74 is provided with the third temperature sensor 53, and the supply path heater 54 is controlled on the basis of the detection result of the surface temperature of the thermal conductor 74. For this reason, the thermal conductor 74 can be kept substantially at the target temperature, and the heated ink in the connection pipe 48 can be heated to remove the temperature difference by the heat transmission from the thermal conductor 74 kept substantially at the target temperature.

(19) The heat keeping device 73 is provided with the head cover 85 (heating member) conducting the heat of the head heater 45 to perform heating, from the peripheral portion of the nozzle forming face 81*a* over the head side wall. Accordingly, the heat of the head heater 45 is transmitted to the peripheral portion of the nozzle forming face 81*a* through the head cover 85, and the printing head 43 can be kept at the target temperature from the nozzle 84 side that is the downstream end of the flow path. Therefore, the nozzles 84 and the liquid just near the upstream side of the nozzles 84 can be kept at a proper heating temperature, and thus it is possible to realize a satisfactory ejection by ejecting the ink with low viscosity from the nozzles 84.

(20) The head heater 45 is provided with the second temperature sensor 44, and the head heater 45 is controlled on the basis of the detection result of the surface temperature of the head heater 45. Accordingly, the head heater 45 can be kept at the target temperature, the heat of the head heater 45 kept at the target temperature can be transmitted to the peripheral portion of the nozzle forming face 81*a* through the head cover 85, and thus the head portion 81 can be kept at the target temperature even when the head body 80 is made of resin. As a result, the nozzles 84 and the liquid or just near the upstream side of the nozzles 84 can be kept at a proper heating temperature, and thus it is possible to realize a satisfactory ejection of ink droplets.

(21) Since the heat of the head heater 45 is transmitted to the head cover 85 through the heating plate 86, it is possible to efficiently transmit the heat to the head cover 85.

The embodiment may be modified to other embodiments as follows.

The second cleaning is not limited to the method of performing the second cleaning by driving the third pump 39 (pressurization pump). For example, the second cleaning may be performed by driving the fourth pump 50 (supply pump). That is, the N fifth opening and closing valves 56 installed on the ink circulation pipe 55 are closed, and the fourth pump 50 is driven. In a state where the flowing of the ink is blocked by the closed fifth opening and closing valve 56 in the ink circulation pipes 55 on the downstream side of the printing heads 43, the ink is transported to the printing heads 43 through the third ink supply pipes 47 by driving the fourth pump 50, the ink pressure in the printing head 43 is raised at once, and the ink is strongly discharged from the nozzles.

Figure 12:
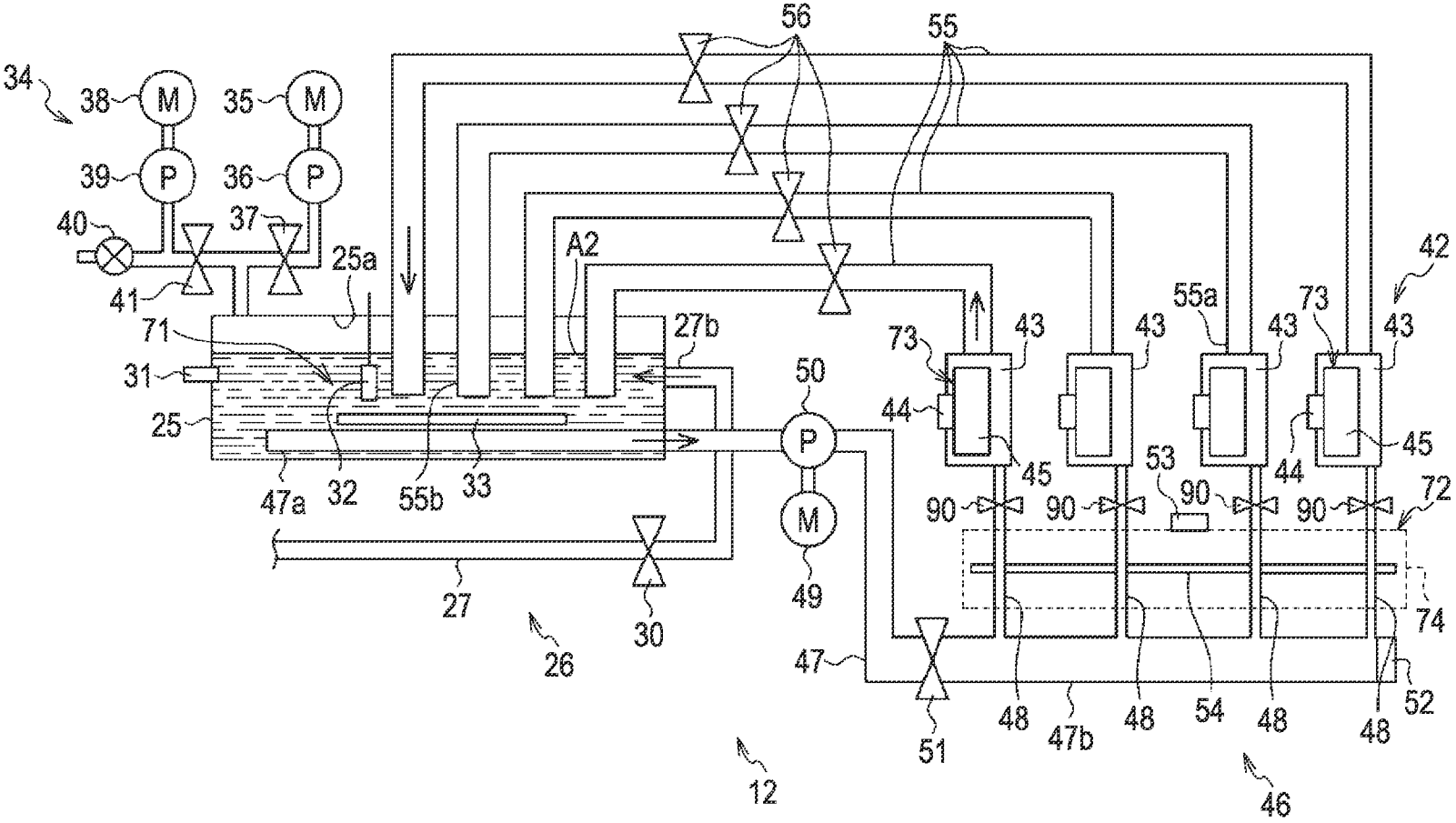
FIG. 12 is a schematic view illustrating a part of a printer according to a modified example.

In the embodiment, as the configuration and method of performing the second cleaning (nozzle cleaning) to dissolve the nozzle clogging, a configuration shown in FIG. 12 may be employed. For example, a configuration and method of discharging the ink from the nozzles of the printing head 43 by driving the fourth pump 50 in the state where all the fifth opening and closing valves 56 are closed, may be employed. In this case, as shown in FIG. 12, N sixth opening and closing valves 90 are provided on the connection pipes 48 branched in parallel from the third ink supply pipe 47, the fourth pump 50 (supply pump) is driven in a state where all the sixth opening and closing valves 90 are closed, and the ink on the side further upstream than the sixth opening and closing valves 90 is pressurized. At the time point (pressurization completed time point) when the ink pressure is sufficiently raised, the M sixth opening and closing valves 90 corresponding to the printing heads 43 of the cleaning targets are selectively opened, thereby realizing the nozzle cleaning. As described above, the nozzle cleaning may also be performed by the fifth opening and closing valves 56 provided on the ink circulation pipes 55 and the sixth opening and closing valves 90 on the connection pipe 48 and the fourth pump 50 sending the ink from the sub-tank 25 to the printing heads 43 through the third ink supply pipe 47. In this case, the heated ink stored in the third ink supply pipe 47 is supplied to the printing head 43 to perform the cleaning of discharging the ink. The printing head 43 is filled with the heated ink after the cleaning is completed. Accordingly, the next printing is satisfactorily performed by ejecting the heated ink. On the other hand, as described above, when the pressurized ink is allowed to flow backward in a direction opposite to the ink supply direction through the ink circulation pipe 55, the cooled ink in the ink circulation pipe 55 flows into the printing head 43, and then the printing cannot be started for some time until the ink in the printing head 43 is heated. On the other hand, in the second cleaning, the ink flows in the supply direction. Accordingly, the printing head 43 is filled with the heated ink after the nozzle cleaning is completed, and thus the printing can be started after a relatively short time until the temperature is stabilized.

In FIG. 12, the N sixth opening and closing valves 90 may be selectively opened and closed to perform the first cleaning. That is, the M sixth opening and closing valves 90 selected as the cleaning targets among the N sixth opening and closing valves 90 are opened, and then the fourth pump 50 (supply pump) is driven to circulate the ink on the circulation path passing through the M printing heads 43 of the cleaning targets. Of course, as shown in FIG. 12, when the fifth opening and closing valves 56 are provided on the ink circulation pipes 55, it is obvious that at least the M fifth opening and closing valves 56 corresponding to the printing head 43 of the cleaning targets are opened. In the case of performing such first cleaning, it is not necessary to consider the ink pressure Phncl of the printing head 43 of the non-cleaning target blocked by the closed sixth opening and closing valve 90, and it is preferable to set Phcl as the negative pressure value PD of the sub-tank pressure Psub. In addition, the disposition of the fourth pump 50 that is the supply pump may be transferred close to the ink circulation pipe 55 in a state where liquid can be sent in a reflow direction, and the second cleaning may be performed by allowing the ink to flow onto the path passing through the third ink supply pipe 47 (supply path). In this case, the third pump 39 (pressurization means) is driven with the N sixth opening and closing valve 90 closed, the sub-tank 25 is pressurized to be a pressurized state, the M sixth opening and closing valve 90 is opened after the pressurization (compression) is completed, and the ink is sent to the M printing heads 43 through the third ink supply pipe 47 (supply path), thereby performing the second cleaning. When all of the first cleaning and the second cleaning are performed by selectively opening and closing the sixth opening and closing valves 90, the fifth opening and closing valves 56 on the ink circulation pipes 55 may be removed.

In the embodiment, a plurality of sub-tanks 25 as tanks which individually correspond to the printing heads 43 may be provided. In this case, the downstream ends of the ink circulation pipes 55 are inserted or connected to the sub-tanks 25.

In the embodiment, only one of the main tank and the sub-tank may be employed, and the ink may be supplied and circulated using only one tank between the one tank and the printing head 43. The ink cartridge may be used as the tank. In this case, when the ink cartridge is mounted on the holder portion, the ink cartridge may be connected to the upstream end of the supply path and the downstream end of the circulation path, and may be connected to the second pump 36, the third pump 39, and one end of the flow path connected to the pressure open valve 40. In the ink cartridge, ink may be directly stored in a case, and an ink pack may be housed in the case.

In the embodiment, each variable throttle valve may be provided at some point on each ink circulation pipe 55, the flow path resistance R3 of the ink circulation pipes 55 may be adjusted in unison or individually by adjusting the throttling amount of the variable throttle valves. For example, the ink pressure in the printing head 43 may be adjusted to be a proper value by controlling the throttling amount of the variable throttle valve, according to the duty value D.

In the embodiment, the negative pressure value of the depressurizing time of the sub-tank 25 may be acquired by the following method. Printing data (liquid ejecting process data) is analyzed, the number of printing dots per unit time is calculated, an ink ejection flow rate (cc/min) is estimated from the value of the calculated number of printing dots, and a negative pressure value corresponding to the estimated ink ejection flow rate is acquired with reference to table data or the like. For example, the maximum ink ejection flow rate Qhm (cc/min) in the course until the printing is completed (i.e., during the printing period) is calculated on the basis of the printing data, and a constant value Qo is added to the maximum ink ejection flow rate Qhm, thereby calculating the ink supply flow rate Qin (=Qhm+Qo). For example, the constant value Qo is a necessary ink circulation flow rate Qout, or a value of ink circulation flow rate Qout+margin flow rate. In this case, the ink of the constant value Qo or more always flows on the circulation path during the period from the start to the end of the printing.

The printing data (liquid ejecting process data) is analyzed, the ejection flow rate after a predetermined time elapses in the range of 10 milli-seconds to 10 seconds from the present time during the printing is sequentially calculated and estimated on the basis of the analysis result, and the sub-tank 25 may be controlled to be depressurized in real time to be a negative pressure value corresponding to the ejection flow rate from time to time. The predetermined time corresponds to a response time represented by the sum of a necessary time until the inside of the sub-tank 25 actually becomes the negative pressure value after the pressure control of controlling the inside of the sub-tank 25 to be the negative pressure value (target pressure value) and a necessary time until the liquid pressure of the ink meniscus in the nozzles after the sub-tank 25 becomes the target negative pressure value.

In the embodiment, the ink supply flow rate Qin may be variable. For example, when Qhmax is variable according to the printing mode (ejection mode), Qin is variable in the range satisfying the relation of Qin>Qhmax. When the ink ejection flow rate Qh can be estimated by analyzing the printing data (liquid ejecting process data), Qin may be variable to satisfy the relation of Qin>Qhmax according to the estimated ink ejection flow rate Qh. The ink may be supplied at the ink supply flow rate Qin satisfying Qin=Qh+Qoutcnst (Qoutcnst is a constant value) such that the ink circulation flow rate Qout is as constant as possible. With such a configuration, even when the ink ejection flow rates Qh are different from each other among the printing heads 43, the ink circulation flow rate Qout can always be made constant (=Qoutcnst). Accordingly, it is possible to substantially reduce the differences of ink pressure among the printing heads 43.

In the embodiment, the relation of the flow path resistance may be R3<R1<R2. In this case, the flow path resistance R of the third ink supply pipe 47 is determined substantially by the flow path resistance R2 of the connection pipe 48, and thus it is unchanged that the relation of R>R3 is satisfied. As described above, the flow path resistance R3 of the ink circulation pipe 55 is lowest among the flow rate resistances, fluctuation of ink pressure in the printing head 43 is further reduced, and thus it is possible to further reduce the difference in ink pressure among the printing heads 43. As a result, it is possible to reduce difference in size (or weight) of ink droplets among the printing heads 43.

In the embodiment, the third ink supply pipe 47 may be installed for each printing head 43. Also in this configuration, it is possible to obtain the same effect when the relation between the flow path resistance R of the third ink supply pipe 47 and the flow path resistance R3 of the ink circulation pipe 55 satisfies R>R3.

The pipe portion 47*c* (pipeline) may be inserted to extend substantially parallel to the bottom of the sub-tank 25. For example, the pipeline may be inserted to extend in a state where the upside of the sub-tank heater 33 is substantially parallel to the bottom (or liquid surface) of the sub-tank 25. The pipeline may be inserted to extend in a direction intersecting a direction substantially parallel to the bottom (or liquid surface) of the sub-tank 25.

The heating block is not limited to the plate shape, and may be a rectangular parallelepiped shape, a cube shape, a cylindrical shape, a spindle shape, and a plate-shaped block having a convex branch extending along a part (the piping path of the connection pipe) where the connection pipe runs through the inside thereof on one face of the front surface and the back surface. The connection pipe may be covered by the heating block, and the heating block is not limited to the structure in which the connection pipe is interposed between two members (block and plate), and may have, for example, a structure in which the connection pipe penetrates a through-hole formed in the heating block.

The tank may be disposed below the liquid ejecting head in the gravity direction or at the same height. In this case, in order to secure an ink pressure necessary for the inside of the liquid ejecting head, during the printing operation (liquid ejecting operation), the tank is not depressurized but may be pressurized by pressurization means.

Only one of the tank and the supply path may be provided with the heating unit. The liquid ejecting head may not be provided with the heating unit (heat keeping means). In this case, in order to improve the heat keeping property of the liquid ejecting head, it is preferable to cover the chamber in the liquid ejecting head or the flow path with a material having an excellent heat keeping property.

The ink jet printer applied to the invention may be any of a line printer, a serial printer, and a page printer.

In the embodiment, the circulation path may include one circulation return path and a plurality of discharge paths as described in JP-A-11-342634.

In the embodiment, the liquid may be supplied from the main tank (ink tank) to the liquid ejecting heads through the supply paths as described in JP-A-11-342634.

In the embodiment, the cutoff means is not limited to the opening and closing valve like the fourth opening and closing valve 51, but may be, for example, the fourth pump 50. For example, if the fourth pump 50 can cut off the flowing of liquid like a gear pump, the fourth pump 50 may be used as the cutoff means. In this case, the fourth opening and closing valve 51 may be removed.

Means (liquid supply means) for supplying and stopping supplying the ink as an example of liquid may be the opening and closing valve installed on the way of the supply path, in the case of a method of supplying the ink using liquid head difference. That is, when the opening and closing valve is opened, the liquid is supplied from the tank to the liquid ejecting head using the liquid head difference. When the opening and closing valve is closed, the supplying of the liquid from the tank to the liquid ejecting head is stopped.

The printing head 43 may be a piezoelectric printing head, an electrostatic printing head, and a thermal printing head.

The negative pressure value of the sub-tank 25 is variable according to the duty value D, but the negative pressure value may be constant.

The ink as liquid is not limited to the UV ink, and may be, for example, thermosetting ink, aqueous or oil pigment ink, and dye ink.

The target is not limited to the resin film, and may be paper, cloth, and metal film.

In the embodiment, the liquid ejecting apparatus is embodied by the ink jet printer 11, but is not limited thereto, and may be embodied by a liquid ejecting apparatus ejecting or spraying liquid (including liquid material in which functional material particles are dispersed or mixed in liquid, and fluid material such as gel) other than ink. For example, it may be a liquid ejecting apparatus that ejects liquid including, in a dispersed or dissolve state, a material such as an electrode material and a color material (pixel material) used to produce a liquid crystal display, an EL (electroluminescence) display, and a surface emitting display, a liquid ejecting apparatus that ejects a bioorganic material used to produce a bio chip, and a liquid ejecting apparatus that ejects liquid as a sample used as a precision pipette. In addition, it may be a liquid ejecting apparatus that ejects lubricant at a pinpoint to a precision instrument such as a watch or a camera, a liquid ejecting apparatus that ejects transparent resin liquid such as ultraviolet hardening resin onto a substrate to form a micro hemispherical lens (optical lens) used for an optical communication element and the like, a liquid ejecting apparatus that ejects etching liquid such as acid and alkali to etch a substrate and the like, and a fluid ejecting apparatus that ejects fluid such as gel (e.g., physical gel). The invention can be applied to any of such kinds of liquid ejecting apparatuses.

The technical concept understood from the embodiment and the modified example will be described below.

(A) A liquid ejecting apparatus provided with at least one liquid ejecting head that ejects liquid, the liquid ejecting apparatus including a supply path through which liquid is supplied from a tank to the liquid ejecting head, a circulation path through which liquid is returned from the liquid ejecting head to the tank, at least one opening and closing valve that is installed on the circulation path, corresponding to the liquid ejecting head, and a supply pump that is installed on the supply path and supplies liquid from the tank to the liquid ejecting head, wherein when the cleaning of the liquid ejecting head is performed, the supply pump is driven in the state where the opening and closing valve is opened, the liquid is circulated on the path passing through the liquid ejecting head, the depressurization unit is driven during the driving of the supply pump, and the inside of the tank is made into the negative pressure.

According to the aspect of the invention, the supply pump is driven with the opening and closing valve opened, the liquid flows to be discharged (reflow) from the supply path to the circulation path through the inside of the liquid ejecting head, and the cleaning of removing bubbles and the like in the liquid ejecting heads is performed by the flow. At the cleaning time (during the driving of the supply pump), since the inside of the tank is made into the negative pressure by driving the depressurization unit at the time of cleaning, at least a part of the increase of liquid pressure in the liquid ejecting head caused by increase of a flow rate is offset by the negative pressure of the tank even when the flow rate of the liquid flowing in the liquid ejecting head is increased for cleaning. Accordingly, it is possible to prevent and suppress leakage of liquid from the nozzles at the time of cleaning. In addition, since bubbles are made larger by depressurizing the inside of the liquid ejecting heads, it is easy to remove the bubbles by the flow of the liquid. Therefore, it is possible to perform the cleaning with a good effect while suppressing the leakage of liquid from the nozzles as much as possible.

(B) The liquid ejecting apparatus according to any one of the first to third aspects, wherein the liquid sending unit is the supply pump provided on the supply path, the N opening and closing valves are installed on the downstream side of the supply pump, the supply pump is driven with the N opening and closing valves closed, the area on the side further upstream than the opening and closing valve in the supply path is pressurized, the opening and closing valve corresponding to the liquid ejecting head of the cleaning target is opened among the opening and closing valves on the supply path, and the liquid is discharged from the nozzle of the liquid ejecting head corresponding to the liquid ejecting head of the cleaning target.

According to the aspect of the invention, in the state where all the opening and closing valves of the circulation path and the supply path are closed, the supply pump is driven, the side further upstream than the opening and closing valves in the supply path is pressurized (compressed), and then the opening and closing valve corresponding to the liquid ejecting head of the cleaning target is opened among the opening and closing valves. As a result, the pressurized liquid is supplied to the liquid ejecting head of the cleaning target, and the liquid is strongly discharged from the nozzles thereof. Liquid thickening materials or dust (paper powder, etc.) in the nozzles are removed and cleaned by the discharge of the liquid, and the nozzle clogging is dissolved or prevented.

(C) The liquid ejecting apparatus according to any one of the first to fourth aspects of the invention, wherein M in the first cleaning is the maximum number of cleaning targets per cleaning, and the cleaning of the K ($M \leq K \leq N$) liquid ejecting heads of the cleaning targets of the N liquid ejecting heads is performed at least $|[-K/M]|$ ([ ] is Gauss's symbol, $\|$ is absolute value) times, thereby performing the cleaning of all the K liquid ejecting heads.

According to the aspect of the invention, the cleaning for the K liquid ejecting head is performed for each M liquid ejecting heads by performing division at least ([K/M]+1) times. Accordingly, in the case of performing the cleaning by at least multiple division (K>M), the flow rate of the liquid flowing in the liquid ejecting head can be raised and the cleaning effect is improved, as compared with the case of performing the cleaning for the K liquid ejecting heads just once.

(D) The liquid ejecting apparatus, wherein both of the first cleaning that is the cleaning according to the second or third aspect of the invention and the second cleaning that is the cleaning according to any one of the fourth to sixth aspects of the invention can be performed, and in the case of performing both of the first cleaning and the second cleaning, the second cleaning is performed after performing the first cleaning.

According to the aspect of the invention, in the case of performing both the first cleaning and the second cleaning, the second cleaning is performed after performing the first cleaning, and thus it is possible to effectively perform the cleaning while suppressing the amount of the liquid discharged at the cleaning time to a minimum. For example, when the first cleaning is performed first, the second cleaning is performed in a state where bubbles in the liquid ejecting head have been removed. Accordingly, the second cleaning is performed with the amount of liquid discharged to the extent that the nozzle clogging can be dissolved. On the other hand, when the second cleaning is performed first, bubbles are driven away to the downstream side (e.g., filter side), the bubble are located at a position where it is hard to remove the bubbles at the time of performing the first cleaning thereafter, and thus it is difficult to remove the bubbles. As described above, when it is difficult to remove the bubbles, it is necessary to perform the removal of bubbles, which is to be performed by the first cleaning, by the second cleaning, and a large amount of discharged liquid is necessary, as compared with the amount of discharged liquid necessary for dissolving the nozzle clogging.

(E) The liquid ejecting apparatus according to any one of the second to fifth aspects of the invention, wherein the N circulation paths are installed to communicate with the N liquid ejecting heads, and the relation between the flow path resistance R of the supply path and the flow path resistance R3 of the circulation path satisfies R>R3.

According to the aspect of the invention, since the flow path resistance R of the supply path on the upstream side and the flow path resistance R3 of the circulation path on the downstream side have the relation of R>R3 with respect to the liquid ejecting head in the flow direction at the cleaning time, it is possible to suppress the liquid pressure in the liquid ejecting head corresponding to the closed opening and closing valve to a minimum. For this reason, it is possible to avoid a case where the liquid is discharged from the liquid ejecting heads other than the cleaning targets. Even when the liquid is discharged, it is possible to suppress the amount of discharged liquid to a minimum.

(F) The liquid ejecting apparatus according to any one of the first to sixth aspects of the invention, further including the heating unit that heats liquid at least at a part of the liquid supply system including the tank and the supply path to supply the heated liquid to the liquid ejecting head.

According to the aspect of the invention, since the liquid is supplied to the liquid ejecting head of the cleaning target through the ink circulation path, it is possible to avoid a case where the liquid heated by the heating unit is unnecessarily discharged from the liquid ejecting head by the cleaning. In this case, the liquid is circulated after the cleaning is completed, whereby the heated liquid is supplied from the supply path to the liquid ejecting head, and the inside of the liquid ejecting head can be filled with the heated liquid. The liquid supplied to the liquid ejecting head of the cleaning target to perform the cleaning is supplied to the liquid ejecting head through the liquid supply path. That is, the heated liquid which is heated by the heating unit is supplied to the liquid ejecting head. For this reason, even after the cleaning is completed, the heated liquid is stored in the liquid ejecting head.

Accordingly, even when the liquid ejecting operation is performed immediately after the completion of the cleaning, it is possible to secure the satisfactory ejection performance by the heated liquid.

What is claimed is:

1. A liquid ejecting apparatus provided with N (N≥2) liquid ejecting heads which eject liquid, the liquid ejecting apparatus comprising:

a supply path through which liquid is supplied from a tank to the N liquid ejecting heads;

a circulation path through which liquid is returned from the liquid ejecting heads to the tank;

N opening and closing valves that are installed for the N liquid ejecting heads respectively on at least one of the supply path and the circulation path; and a liquid sending unit that applies a force sending the liquid from the tank toward the liquid ejecting heads, wherein M opening and closing valve(s), among the N opening and closing valves, corresponding respectively to M liquid ejecting head(s), among the N liquid ejecting heads, selected as cleaning targets are selected to be opened and the liquid sending unit is driven to selectively send liquid to the M liquid ejecting head(s) selected as the cleaning target(s) among the N liquid ejecting heads, thereby performing cleaning, where M<N.

2. The liquid ejecting apparatus according to claim 1, wherein the liquid sending unit is provided with a supply pump installed on the supply path, and the supply pump is driven in a state where the M opening and closing valve(s) corresponding to the M liquid ejecting head of the cleaning target(s) is/are opened.

3. The liquid ejecting apparatus according to claim 2, further comprising a depressurization unit that depressurizes the inside of the tank, wherein the depressurization unit is driven to bring about a negative Pressure inside of the tank at the time of performing cleaning.

4. The liquid ejecting apparatus according to claim 2, wherein the liquid sending unit is further provided with a pressurization pump that pressurizes the tank, a cutoff unit capable of temporarily cutting off a flow of liquid from the tank to one of the liquid ejecting heads that is installed at a part other than a side; on which the N opening and closing valves are installed in the supply path and the circulation path, the pressurization pump being driven in a state where the cutoff unit is cut off and the N opening and closing valves are closed, such that the tank obtains a pressurization state, and at least one opening and closing valve corresponding to at least one liquid ejecting heads selected as a cleaning targets is opened to discharge liquid from the nozzles of the at least one corresponding liquid ejecting head.

5. The liquid ejecting apparatus according to claim 2, wherein the N opening and closing valves are installed on the circulation path, the supply pump is driven in a state where the N opening and closing valves are closed to send liquid to the N liquid ejecting heads, and the liquid is discharged from the nozzles of the N liquid ejecting heads, thereby performing cleaning.

6. The liquid ejecting apparatus according to claim 1, wherein the liquid sending unit includes a pressurization unit that pressurizes the tank, a cutoff unit capable of temporarily cutting off a flow of liquid from the tank to one of the liquid ejecting heads that is installed at a part other than a side on which the N opening and closing valves are installed in the supply path and the circulation path, the pressurization unit being driven in a state where the cutoff unit is cut off and the N opening and closing valves are closed such that the tank obtains a pressurization state, and the M opening and closing valve(s) corresponding to the M liquid ejecting head(s) of the cleaning target(s) is/are opened to discharge liquid from the nozzles of the M liquid ejecting head(s) corresponding to the opened opening and closing valve(s).

* * * * *